US005268620A

United States Patent [19]

Hellenberg

[11] Patent Number: 5,268,620

[45] Date of Patent: Dec. 7, 1993

[54] MIXING APPARATUS

[75] Inventor: Leen Hellenberg, Katwijk, Netherlands

[73] Assignee: Fluid Management Limited Partnership, Wheeling, Ill.

[21] Appl. No.: 795,515

[22] Filed: Nov. 21, 1991

[51] Int. Cl.[5] ..... B01F 11/00

[52] U.S. Cl. ..... 318/114; 318/460; 366/209; 366/605

[58] Field of Search ..... 366/108, 109, 110, 111, 366/128, 216, 217, 251, 605, 208, 209; 318/114, 128, 460

[56] References Cited

U.S. PATENT DOCUMENTS

| | | | |
|---|---|---|---|
| D. 254,973 | 5/1980 | Abrenskou-Sorensen | D15/147 |
| 835,846 | 11/1906 | Blalock . | |
| 1,448,446 | 3/1923 | Hulbert . | |
| 1,463,626 | 7/1923 | Marrazzo . | |
| 1,755,763 | 4/1930 | Barber . | |
| 2,797,902 | 7/1957 | Buegler | 259/72 |
| 2,894,309 | 7/1959 | Brzowski | 24/263 |
| 3,018,092 | 1/1962 | Johnson | 259/54 |
| 3,229,964 | 1/1966 | Wiseman | 259/57 |
| 3,284,057 | 11/1966 | Duguette | 259/88 |
| 3,421,053 | 1/1969 | Rinard et al. | 317/157.5 |
| 3,542,344 | 11/1970 | Oberhauser | 259/75 |
| 3,609,921 | 10/1971 | Foster et al. | 51/164 |
| 3,735,962 | 5/1973 | Pagano | 259/72 |
| 3,880,408 | 4/1975 | Karjalainen | 259/72 |
| 4,134,689 | 1/1979 | Abrenskou-Sorensen | 366/110 |
| 4,235,553 | 11/1980 | Gall | 366/208 |
| 4,281,936 | 8/1981 | Schotter et al. | 366/209 |
| 4,568,194 | 2/1986 | Gargioni | 366/213 |
| 4,588,302 | 5/1986 | Pizzi et al. | 366/349 |
| 4,706,443 | 12/1972 | Oberhauser | 259/72 |
| 4,789,245 | 12/1988 | Morbeck | 366/217 |
| 4,842,415 | 6/1989 | Cane et al. | 366/110 |
| 5,066,136 | 11/1991 | Johnson | 366/209 |
| 5,094,541 | 3/1992 | Nelson | 366/185 |

*Primary Examiner*—Bentsu Ro
*Attorney, Agent, or Firm*—Fitch, Even, Tabin & Flannery

[57] ABSTRACT

A control system for mixing materials in a container. A screw-driven pressure plate clamps the container during mixing. Current of the clamping motor driving the screws is monitored and control circuitry allows multiple speed, multiple current draw, automatic switchover operation of the clamping motor. Circuit components are automatically checked, and control over a mixing or clamping operation is assumed if necessary.

40 Claims, 11 Drawing Sheets

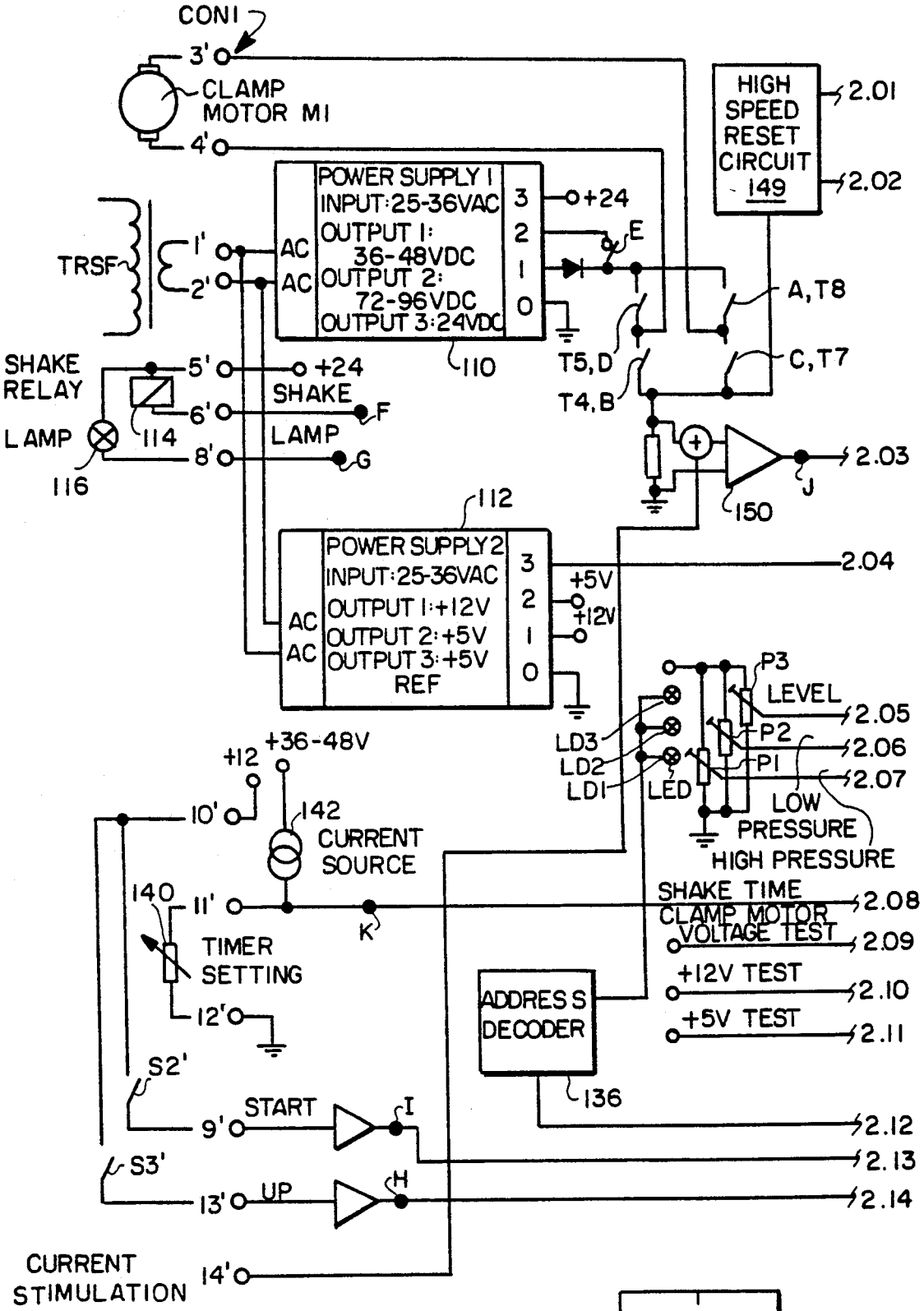
FIG. 2A
FIG. 2
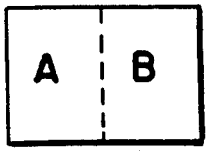

A
B
C
D
170
160
180
184
162
166
TRSF
TR1
IC1
SHAKE MTR.
UP
DOWN
+5V
+12V
3.00
3.01
3.02
3.03
3.04
3.05
3.06
3.07
3.08
3.09
3.10
3.11
3.32
3.31
3.30
3.29
3.28
3.27
3.26
3.25
3.24
3.23
3.22
3.21
3.20V

MIXING APPARATUS

BACKGROUND OF THE INVENTION

1. Field of the Invention

The present invention pertains to apparatus for mixing liquid and pulverulent materials, and in particular, to automatic mixing systems.

2. Description of the Related Art

Paint shakers and other apparatus for mixing paint and the like products in a sealed container have been in wide spread use for some time. One common use for such apparatus is to mix paint products in familiar standardized containers such as quart and gallon sized cans and five gallon plastic pails. Oftentimes, paint is mixed at a store location, one container at a time. After adding colorants and other ingredients, the container is put into a shaker machine for thorough mixing of the ingredients.

However, paint and paint products are also prepared commercially, on a much larger scale, with large numbers of containers being pelletized for shipment to remote locations. At times, pallets of paint containers are stacked one on top of another, with considerable pressure being applied to the lower most row of containers on the bottom pallet. Even if the bottom containers are not ruptured, they may become seriously weakened and may even be partly crushed.

Paint shakers impart a considerable force to a container and its contents, and the container is moved back and forth in a series of short, rapid movements. It is important that the paint container be securely held in the shaker machine. In some paint shaker machines, a band is clamped about the girth or circumference of a paint can, or a series of small clamps are spaced about the periphery of the can lid. Such clamping arrangements, which are typically employed for mixing quart or gallon-sized cylindrical containers, are unsuitable for use with five gallon containers which typically are tapered from top to bottom. Because of the size, weight and asymmetric nature of five gallon containers, it is usually expedient to clamp such containers in an upright position, between a pair of horizontal clamp members. Such clamping arrangements, if made of larger size clamping plates, may also be employed to shake several containers, simultaneously. Five gallon containers of paint products, especially those with masonry fillers are quite heavy, weighing up to 70 pounds or more. A substantial clamping force is required to retain such containers during a mixing or shaking operation and, under normal conditions, adequate clamping force can be achieved without risk of damage to the paint container. However, damaged paint containers, such as those weakened during shipment, prior to a mixing operation, present an abnormal condition which may not be detected upon their loading in a paint shaker machine. Such abnormal containers may even rupture during mixing operation, if care is not taken when clamped in the shaker machine.

With present shaker machines it is not always possible to adequately clamp such weakened containers with pressure sufficient to adequately retain the container during mixing, while limiting the pressure so as not to aggravate the previously compromised integrity of the container. A clamping arrangement which is reliable and easy to use, and which offers a greater precision in the application of pressure to a container is still being sought.

Paint and paint formulations are a worldwide industry and with increasing frequency, larger paint handling operations are encountering different-sized containers, with an increasing number of containers being of an unusual size or proportion and not constructed according to domestic or foreign standardized dimensions. It is important that the paint shaker be readily adaptable to such containers. Further, in the manufacturing environment, it is important that the paint mixers be capable of rapid operation in loading and unloading containers therefrom.

SUMMARY OF THE INVENTION

It is an object according to the present invention to provide mixing apparatus suitable for use with containers, such as paint containers of various sizes and proportions.

Another object according to the present invention is to provide a mixing apparatus which precisely applies an accurately calibrated pressure to the container being mixed.

Another object according to the present invention is to provide a mixing apparatus having a clamping arrangement which can sense abnormal conditions during operation on a container and which can make appropriate responses to such indications.

A further object according to the present invention is to provide a mixing apparatus having decision-making capabilities, and which is flexible so as to respond to a number of different, easily programmable instructions.

These and other objects according to the present invention which will become apparent from studying the appended description and drawings are provided in mixing apparatus for mixing contents in a container comprising:

container contacting means including a support plate and a pressure plate which is movable toward and away from the support plate;

actuator means operable in response to a plurality of driving signals to move the pressure plate toward and away from the support plate at a first, faster speed and at a second, slower speed; and circuit means coupled to said actuator means for producing said plurality of driving signals.

Other objects of the present invention are attained in a mixing apparatus for mixing contents in a container comprising:

a pair of spaced container contacting plates including a support plate and a pressure plate which is movable toward and away from the support plate;

actuator means operable in response to a plurality of driving signals to move the pressure plate in opposite directions toward and away from the support plate;

contact sensing means for sensing contact of the pressure plate with a container located between the pressure plate and support plate including contact sensing signal means for indicating such contact; and circuit means for producing said plurality of driving signals, coupled to said contact sensing means so as to receive said contact sensing signal means, said circuit means responsive to said signal means to change the driving signals to said actuator means, so as to change the movement of said pressure plate in response to said monitoring means output signal.

BRIEF DESCRIPTION OF THE DRAWINGS

In the drawings, wherein like elements are referenced alike;

FIG. 2 is a legend showing the arrangement of FIGS. 2A and 2B;

FIGS. 2A and 2B together comprise a schematic block diagram of a control system according to principles of the present invention;

DETAILED DESCRIPTION OF THE PREFERRED EMBODIMENTS

The present invention is directed to electromechanical systems for mixing containerized materials, such as liquid and pulverulent materials shipped in cans, pails and the like containers for use at locations remote from the material's supplier. The present invention has found immediate commercial acceptance in the paint industry and provides increased flexibility in paint mixing operations for containers of a wide variety of sizes. For example, one commercial embodiment of the present invention is employed in mixing containers used in the paint industry, both domestically and abroad. As will be appreciated by those skilled in the art, there is no set standard for such containers worldwide, and paint materials are being transported in containers of varying sizes and physical qualities. As will be seen herein, control systems according to principles of the present invention provide improved control over a paint mixing operation, and are able to automatically sense and adapt to a wide variety of different containers.

Figure 1:
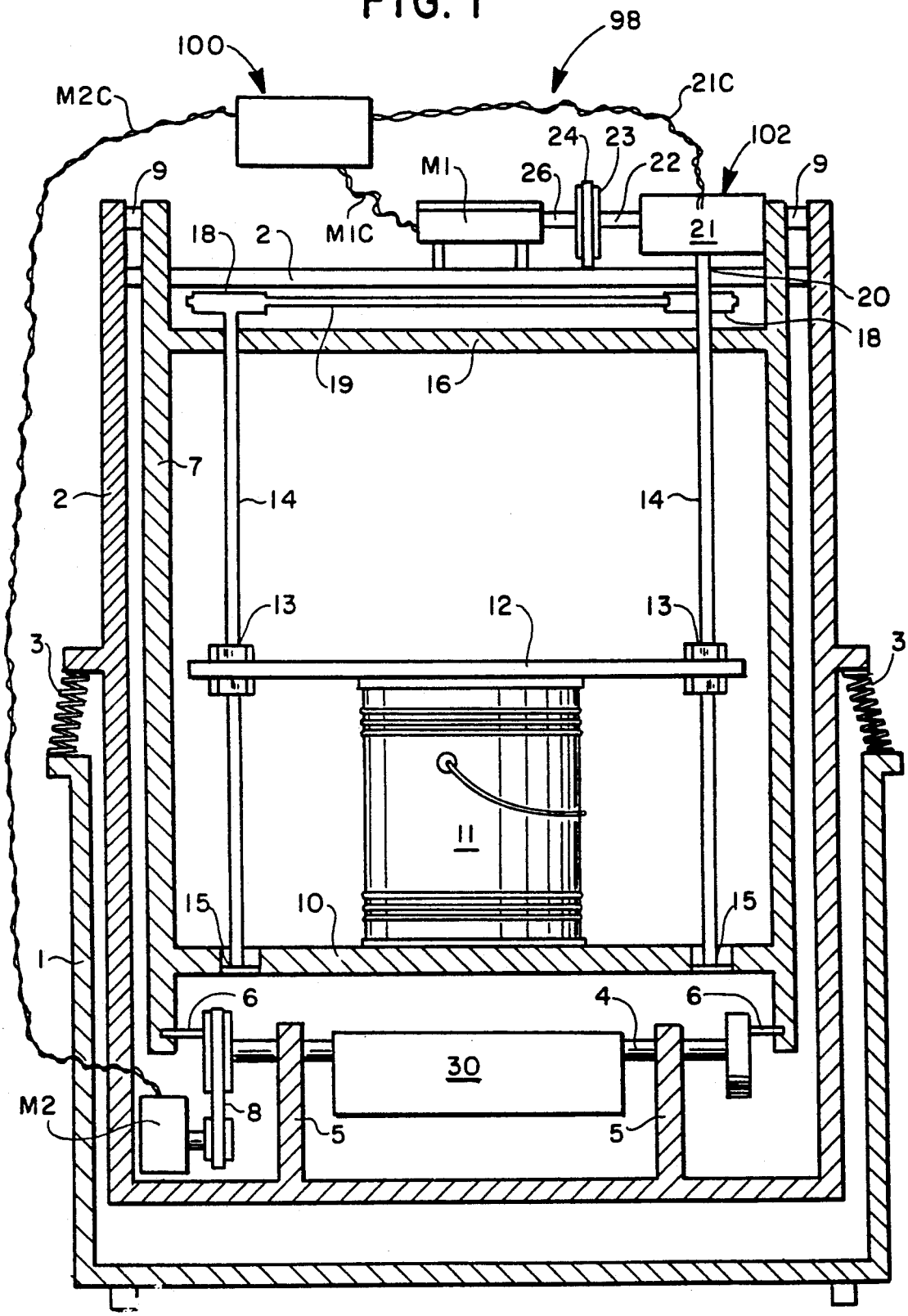
FIG. 1 is a schematic cross-sectional view of mixing apparatus according to principles of the present invention.

Referring now to FIG. 1, mixing apparatus 98 having electronic control is illustrated. An electronic control system generally indicated at 100 is coupled through Various conductors to motors and output sensing equipment of a mixing mechanism generally indicated at 102. The mixing mechanism 102 includes an outer frame 1 which is adapted to be supported on a floor or other horizontal support surface. An intermediate frame 2 is suspended in the outer frame 1 by means of springs 3. Means for applying a mixing motion to an inner frame 7 is located at the bottom of mechanism 102. A shake motor M2 drives a transmission belt 8. A crank 4 is supported by frame 2 via bearing means 5. The crank 4 has two eccentric pins 6 connected to frame 7.

An eccentric weight 30 is fastened to crank shaft 4, being displaced 180° relative to pins 6, so as to be arranged to counter-balance a weight loading of the inner frame 7 in combination with a receptacle or container 11 to be mixed by apparatus 98. The upper part of inner frame is connected to frame 2 by links 9. When motor M2 is energized, the inner frame is subjected to a vibration of a particular configuration, which has been found effective for the mixing of liquid or pulverulent materials in a container 11. Such mixing is commonly referred to in the art as "paint shaking."

It is important that containers 11 be securely clamped to a table 10 carried by inner frame 7, during a mixing operation. Screw fasteners or nuts 13 are fixed to a pressure plate 12 and are displaced by an actuator means which includes lead screws 14. The lower ends of screws 14 are mounted at 15 to a support plate or table 10 in such a manner that the screws are rotatably mounted, but are not axially movable. Together, the plates 10, 12 comprise container contacting means. If desired, either one or both plates 10, 12 could be made movable. An upper cross member 16 of the inner frame is provided with bearings to guide the lead screws 14 for rotational movement. A pulley 18 is fastened at the upper end of each lead screw 14, and an endless belt 19 drives the pulleys in synchronism.

A transmission mechanism 21 is coupled through a drive shaft 20 to one lead screw 14, which in turn drives the other lead screw 14 through the pulleys 18 and belt 19. Transmission 21 preferably comprises an angle-gear and an electro-optical coupler which is coupled through conductors 21C to the control system 100.

A clamp motor M1 is mounted on frame 2 and is coupled through electrical conductors M1C to control system 100 and a shake motor M2 is coupled to control system 100 by conductors M2C. An output shaft 26 of motor M1 is coupled through a pulley 23 to an input shaft 22 of transmission mechanism 21. The clamp motor M1 can be positioned in-line with input shaft 22, but in the preferred embodiment is horizontally displaced therefrom. Accordingly, an endless belt 24 may be employed to couple the shafts 26, 22 together. Alternatively, as mentioned, shafts 26, 22 can be directly connected together with pulleys 23 and belt 24 being omitted, if desired.

The mixing mechanism 102 has met with widespread commercial acceptance in part, because it is very compact while providing a substantial clamping gap between table 10 and upper cross member 16 of the inner frame 7. Further details of the mixing mechanism 102 may be found in commonly owned U.S. Pat. No. 4,134,689, the disclosure of which is incorporated by reference as if fully set forth herein.

Figure 2B:
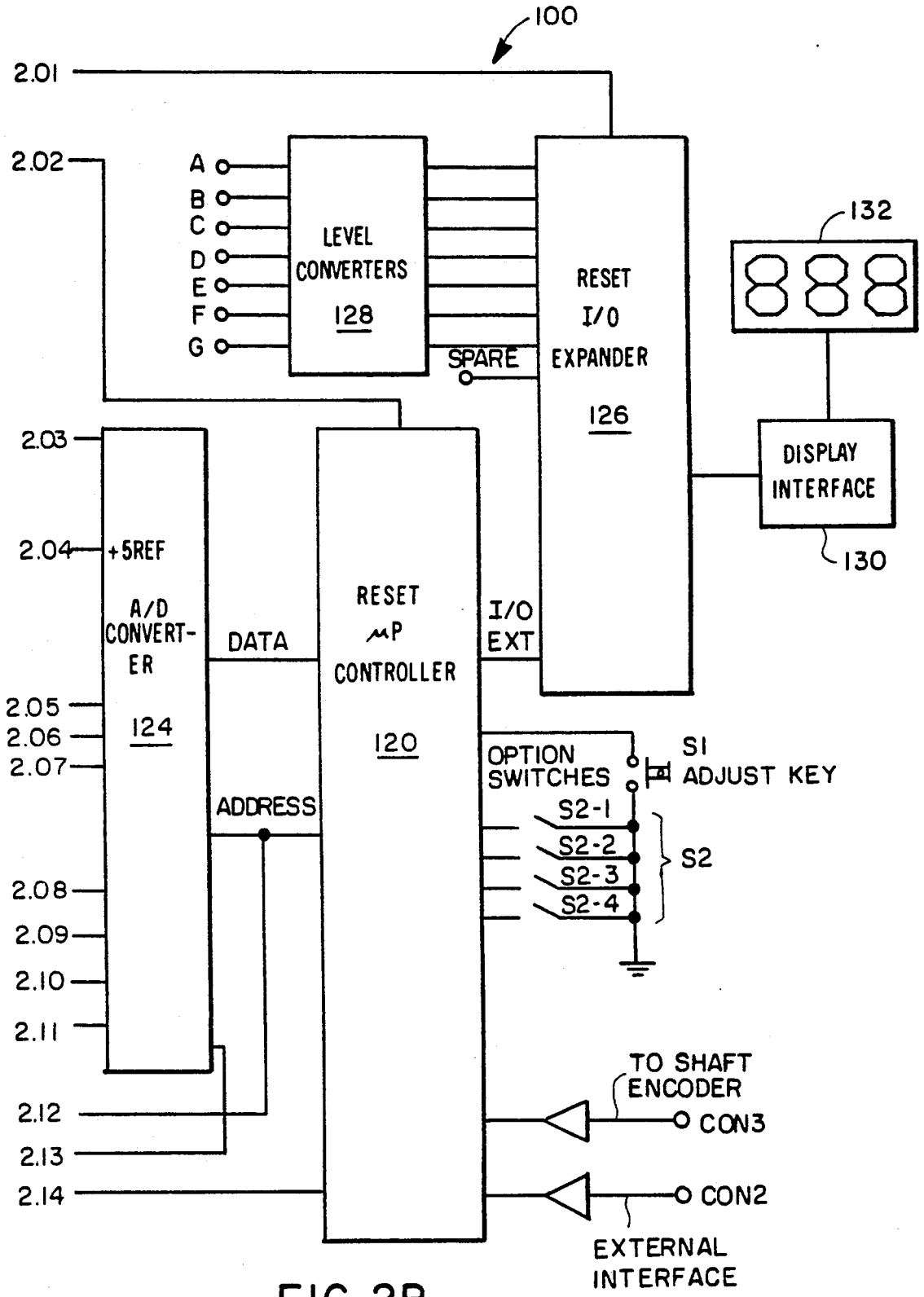

Referring now to FIGS. 2A-2B, a schematic block diagram of control system 100 will now be described. The schematic block diagram of FIG. 2 is divided into two parts, one shown in FIG. 2A and one shown in FIG. 2B. The various electrical circuits broken at the page boundaries between FIGS. 2A, 2B are identified by reference numerals 2.01-2.14 for ease of reference. As mentioned, the control system 100 is coupled to shake motor M2, clamping motor M1 and an opto-coupler or shaft encoder in transmission mechanism 21. The opto-coupler is of a known type which senses the angular displacement and revolutions of lead screw 14 and transmits electrical driving signals through conductors 21C to the control system 100. The control system 100 includes a transformer TRSF and a power supply circuit 110 and 112 to provide electrical energization for various components of the control system.

Figure 5:
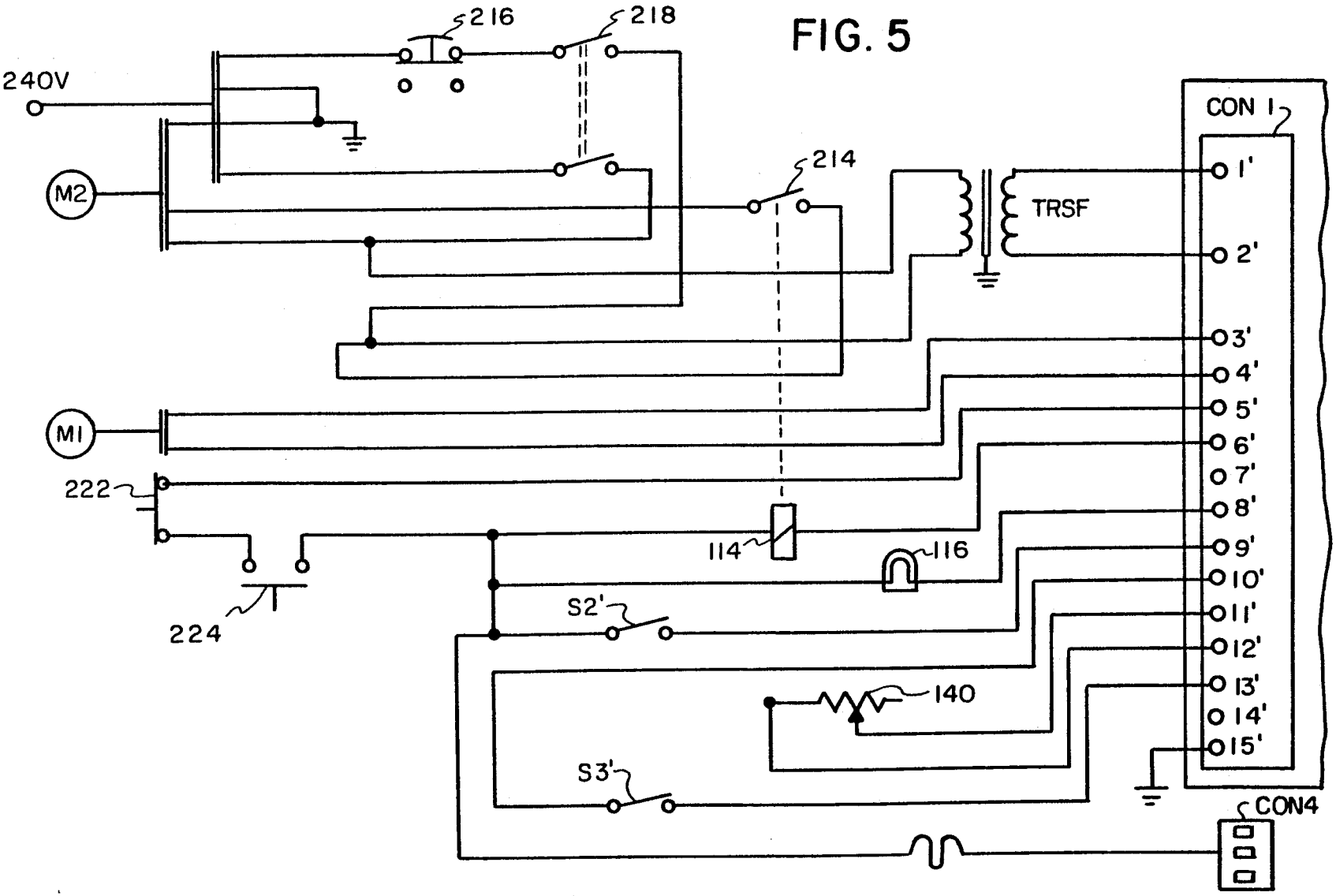
FIG. 5 is a schematic diagram of an interface portion of the control system.

With additional reference to FIG. 5, electrical components such as the clamp motor M1 and a shake motor M2 associated with mechanism 102 are coupled to control system 100 through electrical terminals 1'-15', which together comprise a first connector designated CON1 which is also shown in FIG. 2A. For example, clamp motor M1 is coupled to control system 100 through terminals 3', 4'. The aforementioned transformer TRSF is coupled through terminals 1', 2' to the power supply circuits 110, 112. The shaker motor M2 is coupled through a shake relay 114 to terminals 5', 6' and an indicating lamp 116 is coupled through terminal 8' to control system 100.

Operating switches are provided on mechanism 102, including push button switches S2' and S3' which, as illustrated in FIG. 2A, receive power from terminal 10'. Switch S2' is coupled through terminal 9' to indicate the start of a mixing operation. Switch S3' is coupled through terminal 13' to control circuit 100, to indicate that upward motion of clamping plate 12 is called for. As will be seen herein, the electrical power and in particular, the current drawn by clamping motor M1 and hence the pressure applied to a container is closely monitored by control system 100. Components monitoring the motor current are calibrated by current simulation equipment which can be coupled to the control system through terminal 14'. Terminal 15' provides a ground for various electrical components of the control system 100 as well as components associated with the mixing mechanism 102. The preferred actuator means includes an electric motor, although air-driven motors would also be used, with power being monitored using conventional techniques.

As shown in FIG. 5, but not in FIG. 2A, permissive switches are connected to break the electrical circuits to the shake relay 114, shake indicator lamp 116 and the start switch S2'. The permissive switches include a safety switch 222, and a front door switch 224 for sensing opening of a front door of a cabinet which surrounds the mixing mechanism 102.

Referring now to FIG. 2B, the operating conditions of these permissive switches are investigated at start up, by a microprocessor controller 120. The microprocessor controller 120 receives input from an A/D converter 124 and also from I/O expander circuit 126. The I/O expander circuit 126 is coupled through level converter means 128 to terminals A-G located at various points throughout the control system. The I/O expander circuit 126 is also coupled through a display interface 130 to an annunciator or visual display 132.

As mentioned above, the transmission mechanism 21 includes an opto-coupler which supplies electrical signals to the control system 100. The opto-coupler is connected through connector CON3 to microprocessor controller 120. The third electrical connector CON2 provides optional coupling of an external interface to microprocessor controller 120. The external interface can be used to perform software diagnostics and/or to alter the software program stored in the microprocessor controller 120.

The control system 100 also includes a plurality of user inputs. For example, potentiometers P1-P3 (See FIG. 2A) are coupled to the A/D converter 124. The program loaded in microprocessor controller 120 guides a user to the correct potentiometer at a given time in a set up program routine. Three LED's, LD1-LD3 are associated with the potentiometers P1-P3, respectively for this purpose. The LED's are driven by signals routed through an address decoder 136.

A potentiometer 140 is mounted on the mixer mechanism, and is coupled through terminals 11', 12' to control system 100. A current source 142 provides a reference signal for the potentiometer 140, with the potentiometer developing a reference voltage fed into the A/D converter 124.

As will be explained in greater detail with reference to FIG. 3, the upper left corner of FIG. 2A, shows that the clamp motor M1 is driven by signals routed through an arrangement of switches T4-T8, which are operated by electrical signals routed through terminals A-D. As will be seen herein, the preferred switch is a FET transistor with gate signals applied through terminals A-D, coupled through the level converter 128 to the I/O expander circuit 126. The control signals originate in microprocessor controller 120 in a manner to be described herein.

Associated with the switching circuit that controls clamp motor M1 is a voltage switching means controlled by signals to terminal E, one of the outputs of power supply circuit 110. As indicated schematically in FIG. 2A, control takes the form of a switching operation and, as will be seen herein, provides motor control signals at one of two different operating voltages as determined by signals from microprocessor controller 120. Associated with the control of clamp motor M1 is a high speed reset circuit 149 which is coupled to microprocessor controller 120 and I/O expander circuit 126. The current draw to the clamping motor M1 is sensed by an operational amplifier 150 which has an output coupled to microprocessor controller 120 through A/D converter 124.

With appropriate software, microprocessor controller 120 is programmed to alter the driving signals to the clamping motor so as to selectively change the voltage level of the drive to clamp motor M1, to thereby operate the clamp motor at different speeds, as desired. Other arrangements for changing motor speed could also be employed. The microprocessor controller 120 also controls the direction of current flow through clamp motor MI and hence, its direction of rotation, thus being able to selectively clamp and release a container held in mixing mechanism 102.

The power consumption of the clamp motor is monitored by operational amplifier 150 which forwards an output signal to the microprocessor controller, as explained above. The distance of travel and the absolute position of the clamping plate 12 is monitored by microprocessor controller 120, through a rotation monitoring signal received from the shaft encoder or opto-coupler within the transmission mechanism 21. As mentioned, the control system 100 includes user inputs to define various aspects of a mixing operation and compares these inputs to sensed operating conditions of the mixing system, including various parameters of pressure plate travel such as speed, position, friction forces (due to paint spill on the lead screws), for example. As will be seen herein in greater detail, the user inputs include a determination where speed switching should occur (if this option is available); a higher pressure setting for the clamping plate; and a lower pressure setting for the by potentiometers P1-P3.

Figures 3, 3A:
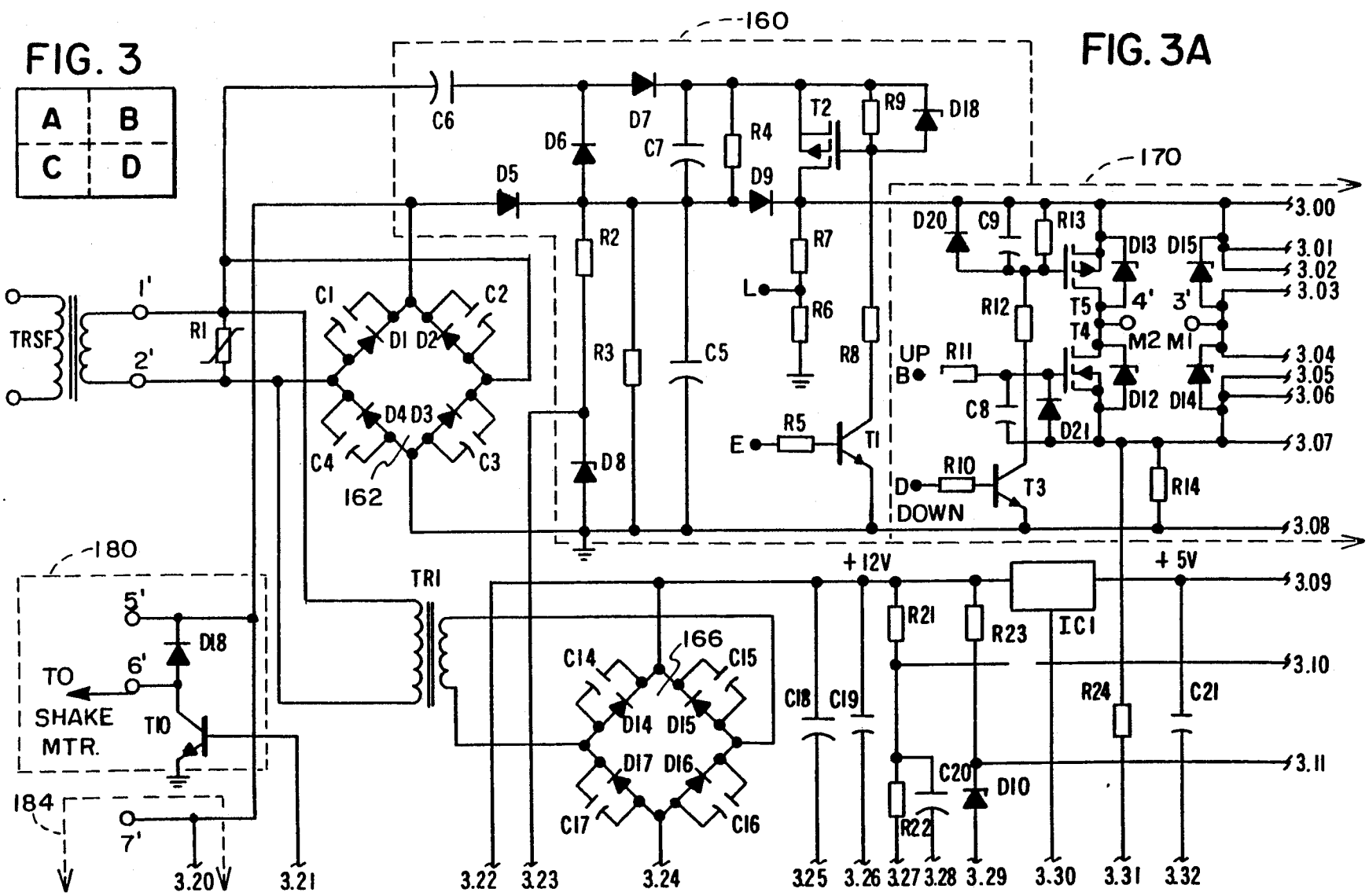
FIG. 3 is a legend showing the arrangement of FIGS. 3A-3D.
FIGS. 3A-3D together comprise an electrical schematic diagram of the control system according to principles of the present invention.

Turning now to FIG. 3, a detailed electrical schematic diagram of control system 100 is divided into four figures, 3A-3D, one on each page. The various circuits extending between FIGS. 3A and 3B have been broken, with end points identified by numbers 3.00-3.11, for ease of reference. The circuits extending between FIGS. 3A and 3C have been broken at the page boundary, within ends identified by numerals 3.20-3.32, for ease of reference. The circuits between FIGS. 3C and 3D have ends at the page boundary identified by reference numerals 3.41–3.49. Finally, the circuits between FIGS. 3B and 3D, broken at the page boundary, are identified by reference numerals 3.60–3.77.

FIG. 3 is a detailed schematic diagram of the control system 100, described in the block diagram of FIG. 2. For example, FIG. 3A includes a voltage doubler circuit 160 having terminal E as a control point. The voltage doubler circuit 160 receives power from a full wave rectifier bridge 162 comprised of diodes D1–D4 and capacitors C1–C4. The rectifier bridge 162 in turn receives power from transformer TRSF coupled to the rectifier bridge 162 through terminals 1', 2', located adjacent resistor R1. Together, the full wave rectifier bridge 162 and voltage doubler circuit 160 roughly comprise the power supply circuit 110 of FIG. 2A. The output of transformer TRSF is fed to a second transformer, designated TR1, which in turn feeds power to various components comprising the second power supply circuit 112 of FIG. 2A. Included is a second full wave rectifier bridge 166 comprised of diodes D14–D17 and capacitors C14–C17. The second power supply circuit is coupled by shunt capacitors C18, C19, resistors R21–R23, capacitor C20 and diode D10 to voltage regulator circuit IC1, preferably of a device type 7805.

Figure 3B:
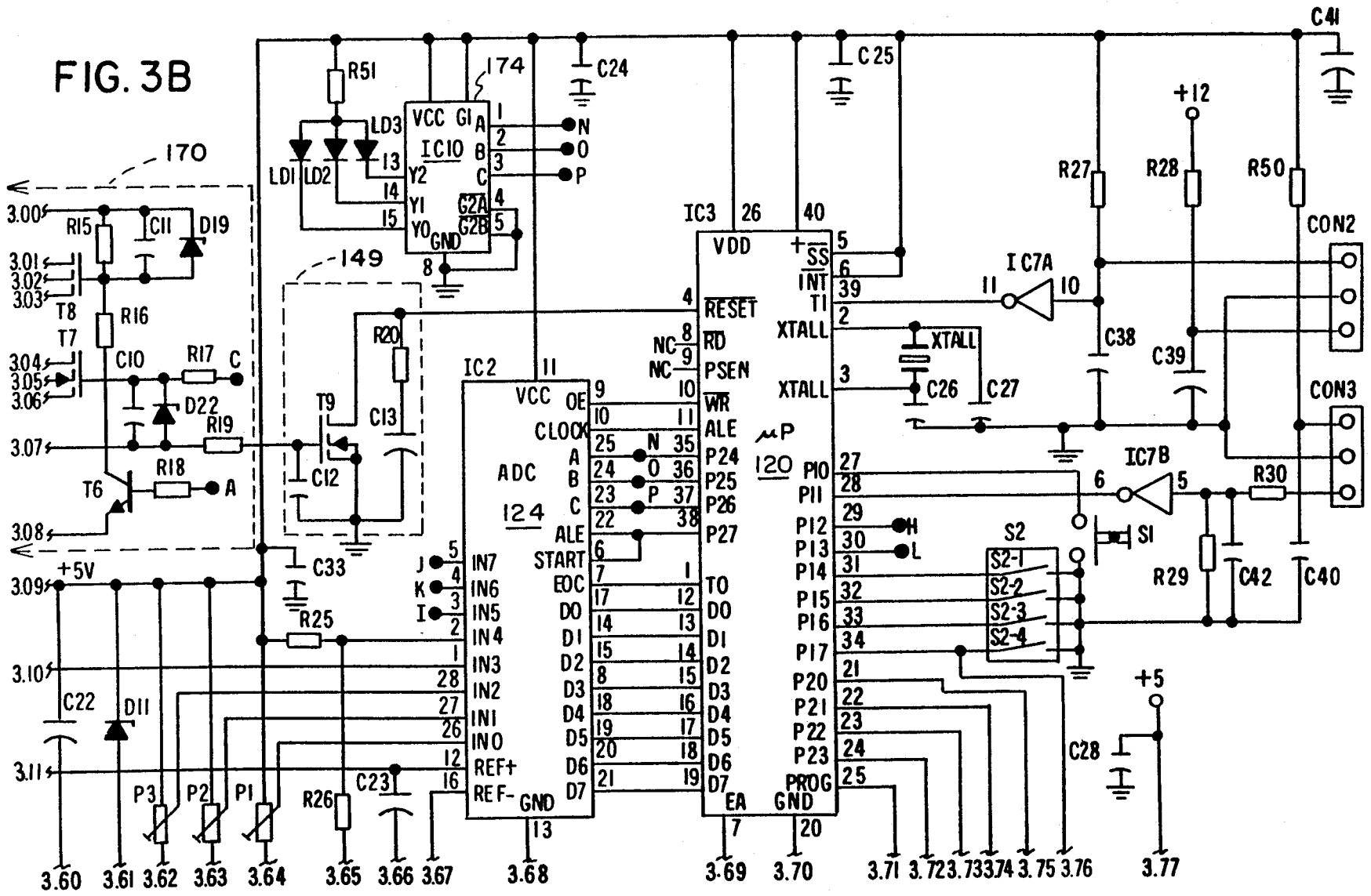

As can be seen in FIG. 3A, voltage doubler circuit comprises capacitors C5–C7, diodes D5–D9 and D15, resistors R2–R9, bipolar transistors T1 (preferably of a type BF393) and FET transistor T2 (preferably of a type IRF9640). The voltage divider resistors R6, R7 provide a reference signal output on terminal L which is fed to pin 30 of microprocessor controller 120, as can be seen in FIG. 3B. A control signal is coupled through base resistor R5 to transistor T1 to switch the level of the applied motor voltage, in response to a control signal inputted through terminal E, outputted on pin 1 of I/O expander circuit 126 which preferably comprises a device type PB243, as can be seen in FIG. 3D.

Referring now to FIG. 3A and the upper left-hand portion of FIG. 3B, a first motor controlled circuit, or motor drive circuit 170 receives a voltage feed from voltage doubler circuit 160. The motor drive circuit 170 includes output switching transistors T4, T5, T7 and T8 (preferably of device type XIRF9640 for transistors T5 and T8, and XIRF740 for transistors T4 and T7). As will be seen herein, transistors T5 and T7 cooperate to form one current path for feeding clamp motor M1 and transistors T8, T4 form a second, reverse direction current path for the clamp motor. Transistor T5 is biased by diode D20, capacitor C9 and resistor R13, and is switched through resistor R12 by transistor T3 (preferably of device type BF393 which pulls down the voltage input to transistor T5). Switching transistor T3 receives a base control signal through resistor R10, fed into terminal D, outputted from I/O expander circuit 126, as can be seen in FIG. 3D.

Transistor T4 is biased by resistor R11, capacitor C8 and diode D21, and receives an input control signal through terminal B, outputted from the top module of IC8, (see FIG. 3D) coupled to pin 3 of I/O expansion circuit 126. The level converter integrated circuit IC8 is preferably of device type HCF40109 and includes four modules, with output terminals 5, 4, 13 and 11, respectively, coupled to output terminals B, C, F, and G, respectively.

Output transistor T8 is biased by resistor R15, capacitor C11 and diode D19, and receives control signals through resistor R16, outputted from transistor T6 (preferably a device type BF393). Transistor T6 pulls down the reference voltage at the input to transistor T8, and receives its control signal through base resistor R18, coupled through terminal A to terminal 2 of I/O expander circuit 126.

Transistor T7 is biased by capacitor C10, diode D22 and resistor R17, and receives its input control signal through terminal C coupled to output terminal 4 of level converter integrated circuit IC8. Diodes D12–D15 protect the output portions of transistors T4, T5, T7 and T8. Clamping motor M1 is coupled to motor drive circuit 170, through terminals 3', 4' located between output diodes D14, D15 and D12, D13, respectively.

The high speed reset circuit 149 is comprised of transistor T9 (preferably of device type BSS89, resistor R20 and capacitors C12, C13).

Referring to the bottom left corner of FIG. 3B, shunt resistor R24, capacitors C21, C22 and diode D11 are located at the output of voltage regulator IC1. Microprocessor controller 120 is coupled to an A/D converter circuit 124, which is preferably of device type ADC08008. Output terminals 23–25 of A/D converter 124 are coupled to microprocessor controller 120 through terminals N, O and P which are connected to an LED driver circuit IC10, preferably of device type 74HCT138. IC10 is identified by reference numeral 174, and drives LED(s) LD1–LD3, through resistor R51, in response to signals fed through terminals N, O and P. Capacitors C24, C25, C41 and C33 are located at the power inputs to LED driver circuit IC10, A/D converter 124 and microprocessor controller 120.

As mentioned, three user input potentiometers are provided by control system 100, the potentiometers designated P1–P3. Resistors R25, R26 provide a voltage divider input to terminal 2 of A/D converter 124, and are connected across the input to potentiometer P1, which provides an output signal to terminal 26 of the A/D converter circuit 124. Potentiometers P2 and P3 provide input signals to terminals 27 and 28 of the A/D converter. Capacitor C23 is located at pin 12, providing a reference signal to the A/D converter circuit 124.

Referring again to FIG. 3B, an external interface is provided at pins 2, 3 and 39 of microprocessor controller 120. An associated interface circuit includes an invertor IC7: crystal XTALL: capacitors C26–28, (38 and(39, resistors R27, R28 and R50. Temporary connection is conveniently made at connector CON2.

The shaft encoder or opto-coupler of transmission mechanism 21 is coupled to microprocessor controller 120 through connector CON3, invertor IC7, resistors R29, R30 and capacitors C40, C42.

As mentioned, the mixing mechanism 102 is preferably enclosed within a cabinet having an access door provided to the user for loading and unloading containers to be mixed within the mechanism. A conventional switch is mounted to the access door to indicate when the door is opened so that safety precautions such as terminating a mixing operation can be taken on a selective basis, if desired. The door switch is connected through connector CON4 for coupling to microprocessor controller 120, through invertor IC7C, resistors R57, R58 and R59, and capacitors C43 and C28 (shown in FIG. 3B).

Capacitors C29, C30 are located at the respective 12 volt and 5 volt power inputs to the level converter circuit IC8. A push switch SI and option selection switches S2-1 through S2-4 are connected to terminals 27 and 31-34 of microprocessor controller 120, as shown in FIG. 3B. As will be explained herein, the option switches S2-1 through S2-4 comprise additional user input settings for the microprocessor controller.

Referring to FIG. 3D, a resistor bank R49 having eight individual resistor elements is coupled to terminals 1-5, and 21-23 of I/O expander circuit 126.

Figure 3C:
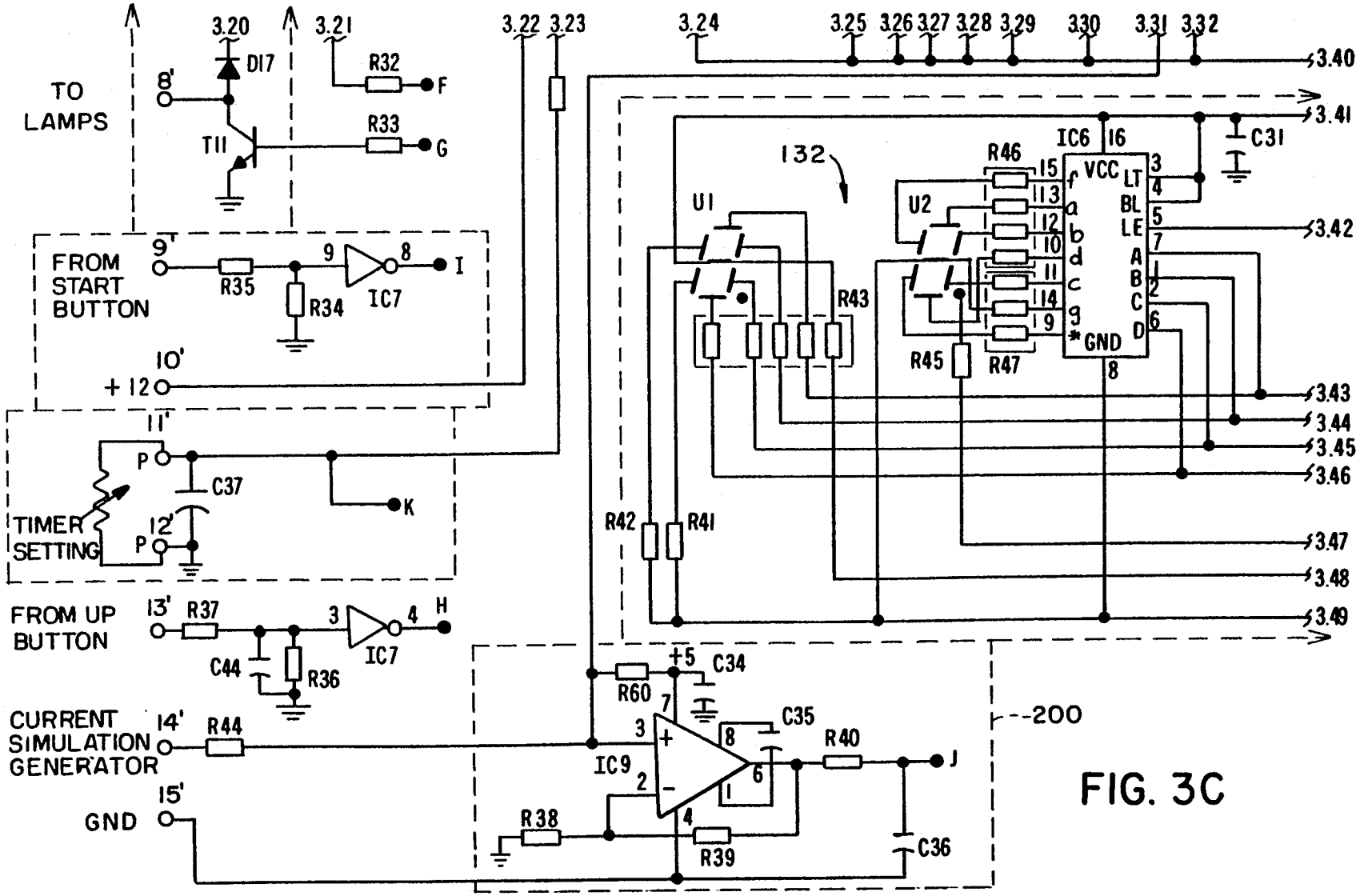
Figure 3D:
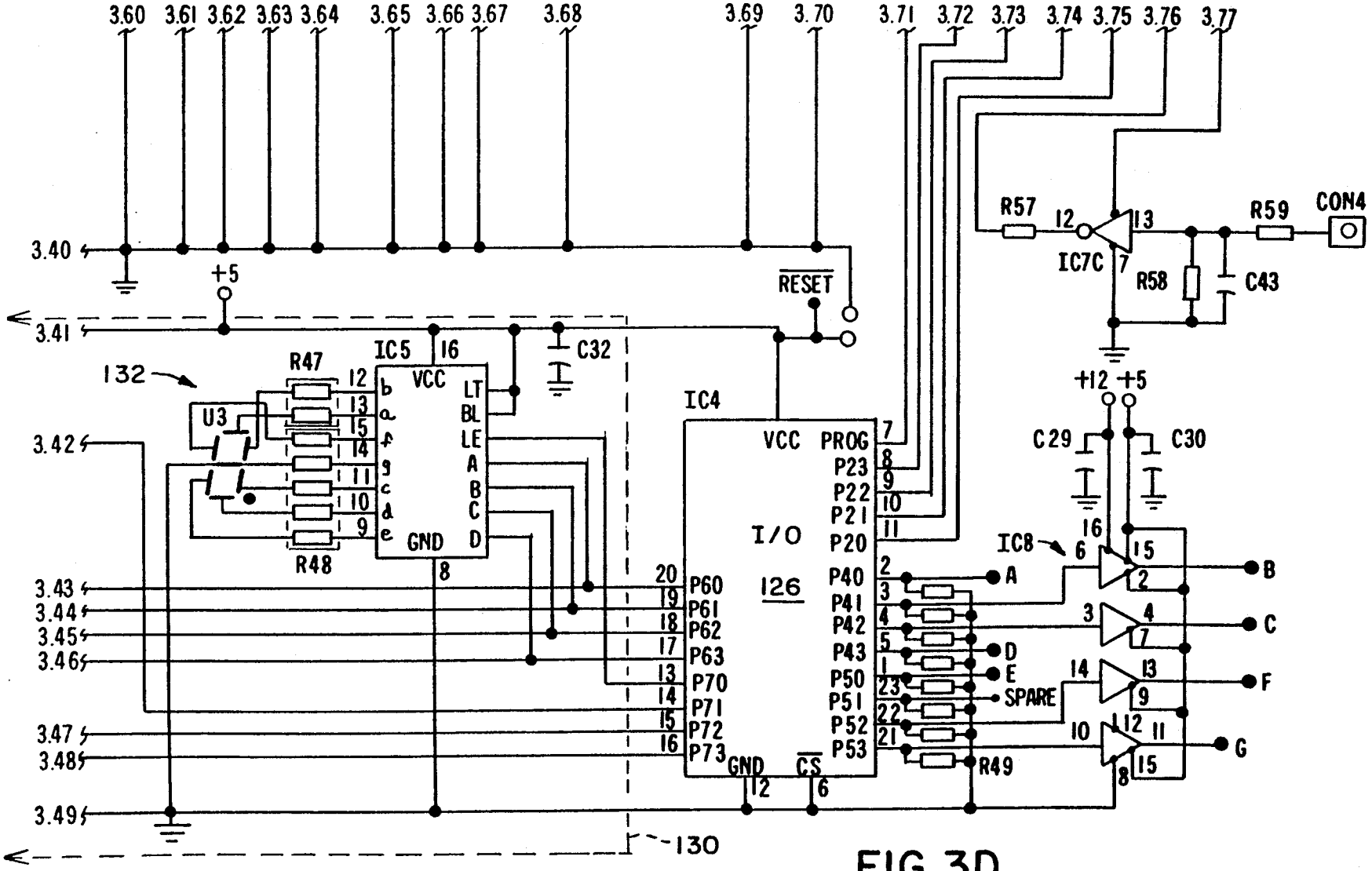

Referring to FIGS. 3C and 3D, three 7½ segment output displays U1-U3 are provided to inform the user of various operating conditions of control system 100. The output displays U1-U3 are controlled by signals on terminals 13-20 of 1/0 expander circuit 126, and display drivers IC5 and IC6, along with capacitors C31, C32 and resistor banks R46, R47 and discrete resistors R41, R42, R45 and resistor bank R43 are employed to drive the output displays U1-U3. Display drivers IC5, IC6 are preferably of device type HEF4511.

Referring to FIGS. 3A and 3B, a mixing drive circuit 180 includes a bi-polar drive transistor T10 (preferably of the type BD241C) and diode D16. The transistor is operated by control signals received at terminal F (see FIG. 3C) and coupled to the transistor through resistor R32. The collector of the transistor is connected to a relay which energizes the mixing or "shake motor" M2. A lamp driver circuit 184 includes a drive transistor T11 (preferably of the type BD241C) and diode D17. Control signals received at terminal G are coupled to the base of the transistor through resistor R33. Transistor T11 completes the lamp circuit, illuminating lamp 116.

The drive transistor T10 provides a current path for the "shake relay" 114 which in turn energizes the mixing motor M2.

The terminals F and G are coupled through IC8 to pins 22, 21 of I/O expander circuit 126, respectively. The start button S2' of FIG. 2A is coupled through voltage divider resistors R35, R34 and invertor IC7 to terminal I. Referring to FIG. 3B, terminal I is connected to pin 3 of A/D converter circuit 124, ultimately providing input to microprocessor controller 120.

Referring also to FIG. 3B, terminal K is connected to pin 4 of A/D converter 124 and provides an input signal from the timer setting potentiometer 140, shown in FIGS. 2A and 3C. Referring to FIG. 3C, capacitor C37 is connected across the potentiometer 140. The terminal 11' of connector CON1 is connected to terminal K and through resistor R31 is coupled to voltage doubler circuit 160. A push button for raising the clamping plate 12 is coupled to terminal H through an invertor IC7 having an input circuit comprised of voltage divider resistors R37, R36 and capacitor C44. Terminal H is in turn connected to pin 29 of microprocessor controller 120.

A motor sensor circuit 200 is coupled to the motor drive circuit 170 through resistor R24 (see FIG. 3A). The resistor R24 couples the motor drive current signal to pin 3 of operational amplifier IC9, preferably of type CA3130. Resistors R38-R40 and R60, and capacitors C34-C36 provide feedback and bias for the operational amplifier circuit. The output of the operational amplifier is coupled to terminal J, connected to pin 5 of A/D converter circuit 124, to ultimately provide an input signal to microprocessor controller 120, which is proportional to either the magnitude of the current drawn by clamping motor M1 or the rate of change of that circuit. As those skilled in the art will appreciate, it is sometimes desirable to calibrate a control circuit under simulated operating conditions. Accordingly, terminals 14', 15' are provided to couple a current simulation generator to IC9 through resistor R44.

Referring now to FIG. 5, a schematic diagram of a portion of the control system, connecting sensors on the mixing mechanism to the electronic circuitry, is shown. The relay coil 114 operates a pair of relay points 214 to energize shake motor M2. A circuit breaker 216 and an on/off switch 218 interrupt power to the control system. As can be seen in FIG. 5, a number of switches interrupt current to the relay coil 114, running lamp 116, and start switch S2'. These switches include safety switch 222, and front door switch 224 which detects opening of the access door in the cabinet surrounding the mixing mechanism. These switches interrupt the flow of power received from terminal 5' of connector CON1. Interruption of power is detected at connector CON4. The switches 222, 224 are connected in series, and if either switch is open, power to the relay running lamp and start switch is interrupted.

Figure 4:
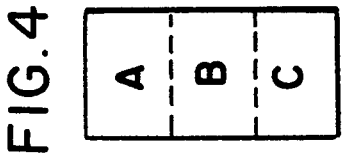
FIG. 4 is a legend showing the arrangement of FIGS. 4A-4C.
Figure 4A:
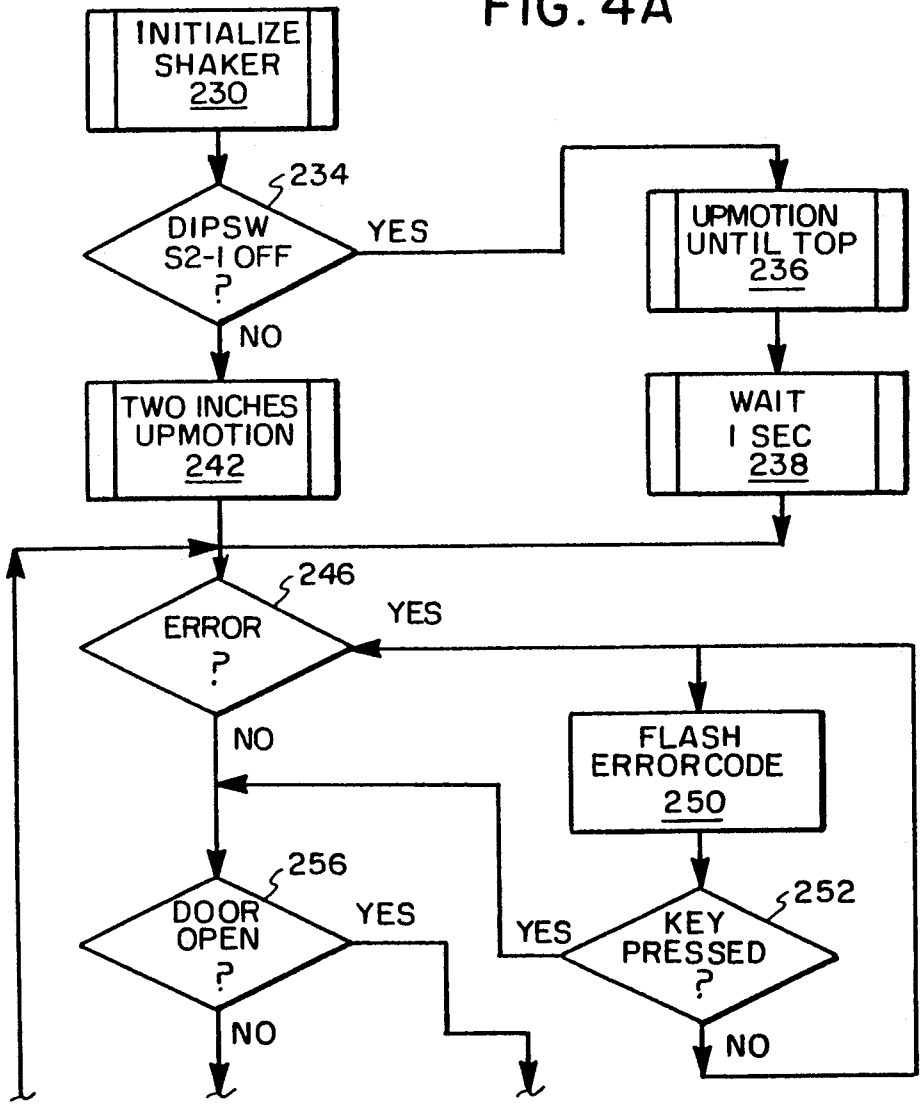
FIGS. 4A-4C together comprise a flow diagram indicating operation of the mixer apparatus, including control system, according to principles of the present invention.

Referring now to FIG. 4, a block diagram indicating microprocessor control of the electronic circuitry will now be described. As will be seen herein, FIGS. 4A-4C together comprise a flow diagram using specialized outlines, also called symbols or boxes. Referring now to FIG. 4A, element 230 is a pre-defined process to initialize the shaker, or mixing apparatus. Included in the initialization process is the generation of reset signals in circuit 149, checking for a voltage at connector CON4, to detect whether one of the switches 222, 224 is open, raising the pressure plate 12 to its end-of-travel condition, zeroing the counter which tracks the revolutions detected by the opto-coupler in transmission mechanism 21, and verifying that the signal at terminal J, output from the operational amplifier IC9, lies within a valid operating range.

Once initialization is completed, program control is transferred to decision element 234 which tests the setting of dip switch S2-1. This dip switch determines if multiple mode operation is called for. The multiple mode operation referred to here includes in part, multiple speed operation, the details of which will be explained herein. The ability to use this multiple mode operation depends upon the hardware arrangement of mixing apparatus 98, and in particular, whether the transmission mechanism 21 includes an opto-coupler or not. As mentioned, an opto-coupler is employed in the preferred embodiment. The presence of decision element 234 assumes the option is available, and if the option were not available, dip switch S2-1 would be locked to an "off" position, preferably causing the control circuit to forego issuing driving signals which result in multiple speed operation. However, multiple speed operation of the control circuit is possible even without an opto-coupler, but is not desired. Assuming that multiple mode operation is not available, setting dip switch S2-1 to the "off" position, indicates that actuation of pressure plate 12 is to be operated in a simplified, single mode of operation.

If dip switch S2-1 is set to an "on" position, multiple mode operation of the pressure plate actuator is enabled with an initialization of the opto-coupler circuitry. The pressure plate 12 is raised to a top position as indicated in predetermined process element 236 and the pressure plate is held for one second as indicated in predetermined process element 238, while the counter-circuit associated with the opto-coupler is initialized at a zero value. Optionally, an histogram of current through the clamping motor (inputted to microprocessor controller 120 from the output of operational amplifier IC9 at terminal J) is analyzed for potential errors. Also, the length of lead screws 14 is known as is the speed, acceleration and other characteristics of the pressure plate actuator system (comprising clamp motor M1 and other components), and thus a maximum time of travel to attain an uppermost clamping plate position can be readily calculated or stored in the microprocessor controller.

Referring again to decision element 234, if dip switch S2-1 is set to a "off" position, program control is transferred to a pre-defined process element 242 which raises pressure plate 12 a defined, relatively small increment, preferably on the order of two inches. During this travel of the pressure plate, a histogram of current draw in the actuator system, primarily that current drawn by clamping motor M1, is analyzed. As mentioned, the present invention contemplates omission of an optocoupler to keep track of the rotation of the twin lead screws 14. In this event, the pre-defined process element 242 should be interpreted as energizing the pressure plate actuator for a time sufficient to raise the pressure plate approximately two inches. Various types of analysis can be performed on the current histogram of the pressure plate actuator system. In the preferred embodiment of the present invention, a current-time relationship is analyzed to determine the instantaneous slopes of the histogram curve and the rate of change of those slopes. It is thus possible to detect an erratic or inconsistent operation of the movable pressure plate 12, and also of its actuator system.

Whichever setting of dip switch S2-1 is chosen, program control is then transferred to decision element 246 which analyzes data collected during clamping plate actuation to determine if an erroneous condition is present. An error condition can also be present if switches 222 or 224 are operated to interrupt voltage at connector CON4. The errors considered in decision element 246 could also be in response to out-of-range conditions in any of the inputs to microprocessor controller 120, and thus, internal checking of the control system circuitry is contemplated, and of course, it is possible to identify the particular type of error encountered. As mentioned, control system 100 includes output display elements U1–U3, and an appropriate error code generated by microprocessor controller 120 is displayed, as indicated in processing element 250. The error code could be stored for later retrieval: however, it is preferred that the error code remain displayed until cleared by an operator, as indicated in decision element 252. A special key switch could be provided for the error clearing operation, or any of the aforementioned switches not in operation at the time could be used for this special purpose. Control is then transferred to decision element 256.

Figure 4B:
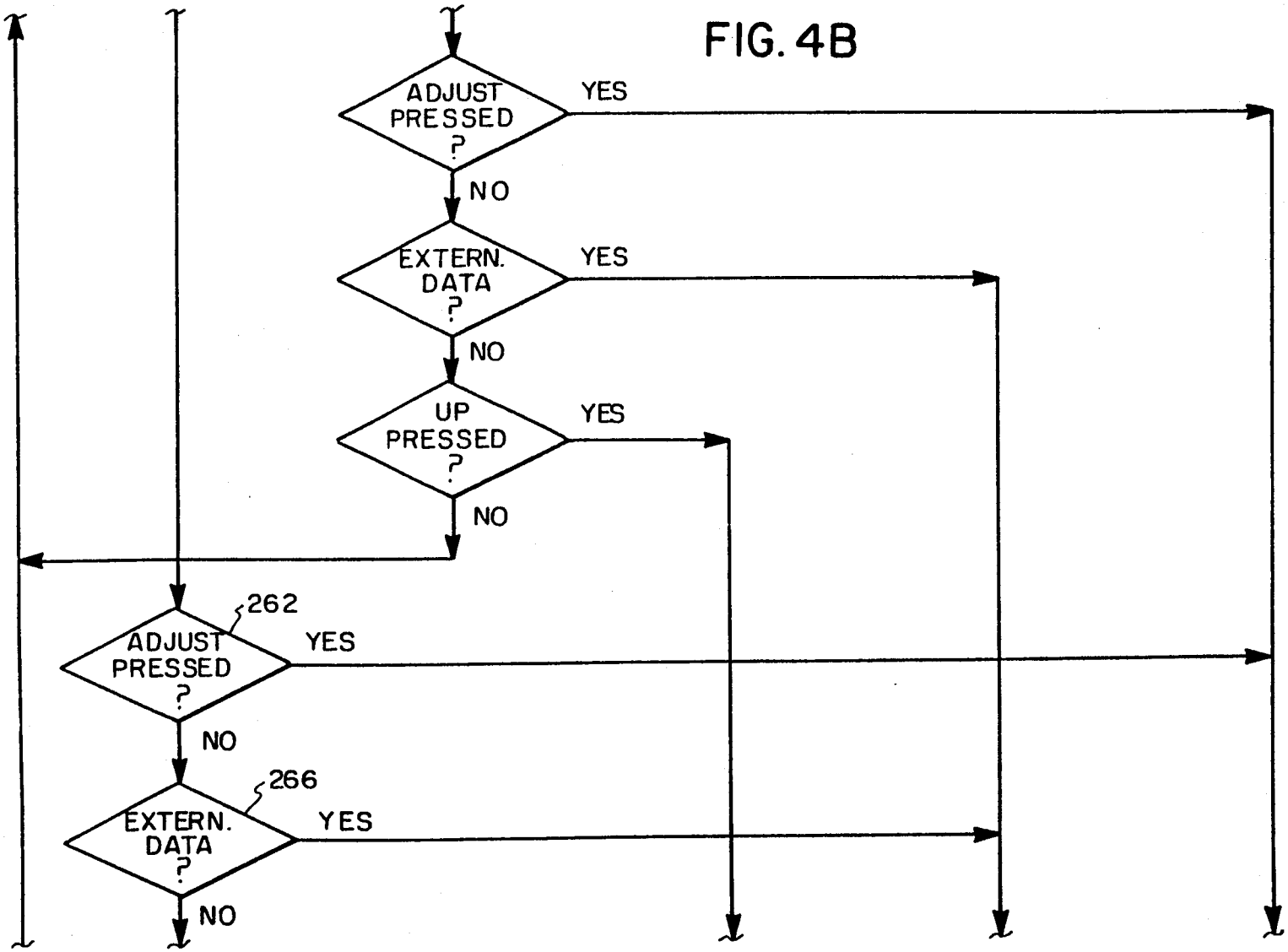
Figure 4C:
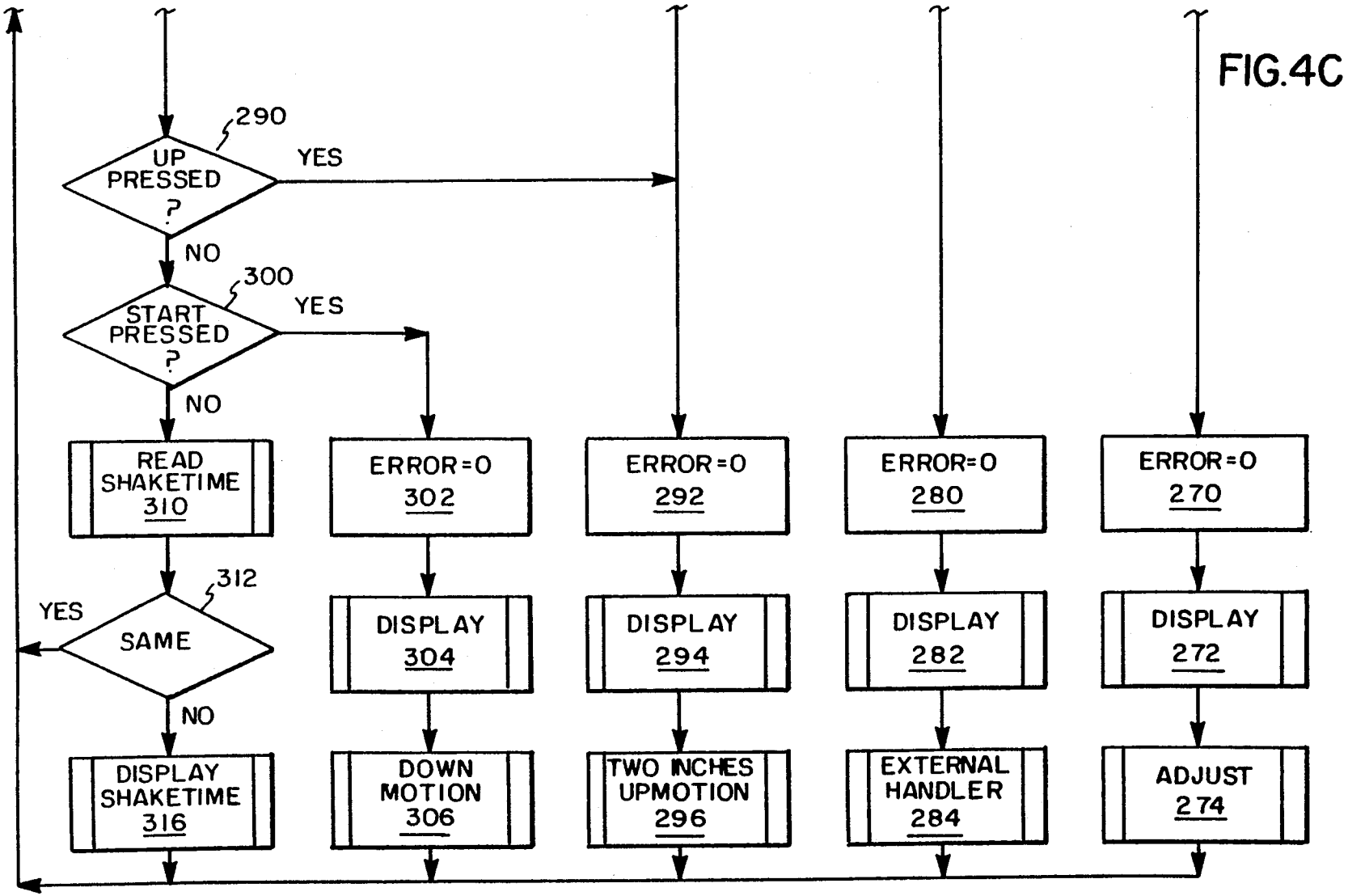

After the error analysis of decision element 246 is completed, control is transferred to decision element 256 to determine if the main access door of mixing apparatus 98 is open, i.e., if switch 224 is activated. As will be seen herein, programming of the mixing apparatus is possible with or without the main access door being closed. Some users may prefer to program the mixing apparatus with the door open to insure operation will not be started until the door is closed. As can be seen in FIGS. 4A and 4C, the same decision elements are handled by the program, whether the main access door of the mixing apparatus is open or closed. For example, if the door is not open, program control is passed to decision element to determine whether the "adjust" switch S1 is pressed. By depressing switch S1 between one and eight times, eight different operating parameters can be set by the user. These parameters can include, for example, infinitely variable settings of potentiometers P1–P3. If desired, the potentiometer settings P1–P3 can be recorded only upon a certain operation of the "adjust" switch S1. However, in the preferred embodiment, it is possible to enter external data by using potentiometers P1–P3, without pressing the adjust key S1. With reference to FIG. 4B, control is passed to decision element 266 to determine whether the potentiometers P1–P3 or perhaps other types of user input have changed.

If the "adjust" key is pressed, control passes to processing element 270 where the error codes are cleared, and then to pre-defined process element 272 where the user receives visual confirmation of the key pressed. Afterwards, control is passed to pre-defined procedure 274 where the particular adjustment is carried out. For example, a typical adjustment would be a change of data stored within microprocessor controller 120 which will affect subsequent operation of the mixing apparatus.

If external data is being entered, control passes to processing element 280 which clears the error codes, displays the data or data entry instructions as appropriate, according to pre-defined process element 282, and stores the external data or modifies the control system as appropriate, according to pre-defined process element 284.

After external data is considered, program control is passed to decision element 290 which examines whether the "up" switch S3' is pressed. If the switch is pressed, control is transferred to processing element 292 which clears the error codes, predetermined process element 294 which confirms the demand for upward motion of clamping plate 12, and to predetermined process element 296 which energizes the clamping plate actuator to attain a predetermined reverse distance or upward displacement of the clamping plate, preferably in the range of 2 inches upward motion. This control can be implemented by a timed energization of the clamp motor, but is preferably implemented by counting rotations of the lead screws.

If the "up" switch S3' is not pressed, control is transferred to decision element 300 which determines whether the "start" switch S2' is pressed. If the "start" switch is pressed, program control passes to processing element 302 which clears the error codes, pre-defined process element 304 which displays the demand to start the control system, and predetermined process element 306 which initiates downward motion of clamping plate 12, so as to securely clamp a container within the mixing apparatus. Control is thereafter returned to decision element 246 to determine if an error has occurred.

If the "start" switch has been processed on a previous cycle and is no longer identified as being pressed, control is passed to predetermined process element 310 which reads the mixing cycle duration of "shake time" stored in microprocessor controller 120. Program control is then passed to decision element 312 which determines whether the shake time has been changed from a previous stored setting. If the time is the same, control is returned to decision element 246. If the time duration has been changed, the new, updated value is displayed according to pre-defined process element 316. Control is then returned to decision element 262. Initiation of a mixing operation for a shake time duration is included in pre-defined process element 306, which initiates mixing after a down motion and clamping operation is successfully completed.

Referring additionally to FIGS. 3A-3D, example operations of mixing apparatus 98 will now be described. The on/off switch 218 is moved to the "on" position, energizing mixing apparatus 98 and the control system 100. At this point in the operation, the apparatus can immediately initiate a diagnostic or initialization procedure. However, it is preferred that such diagnostic or initialization procedures occur after the "start" switch S2' is pressed so as to give an operator an opportunity to immediately perform a limited number of operations. For example, it is preferred that an operator be able to raise the pressure plate 12 by pressing the "up" switch S3'.

Since operation of the pressure plate is entirely dependent upon operator control, it is generally preferred that the "up" switch S3' be of a momentary contact type. If desired, a limit switch can be located adjacent the upper end of the pressure plate travel so as to override the "up" switch S3' as the pressure plate reaches an upper, end-of-travel condition. For safety reasons it is preferred that the "up" switch produce no energization of the clamping motor M1 unless a voltage is present at connector CON4, indicating that neither the safety switch 222 nor the front door switch 224 are tripped.

In response to the "up" switch S3' being pressed, a signal is indicated at terminal H, the output of invertor IC7 (see FIG. 3C). This terminal is coupled to pin 29 of microprocessor controller 120 (see FIG. 3B), thus providing an indication of switch operation. Depending upon the software program stored in microprocessor controller 120, control signals are issued to energize the clamping motor M1.

In the preferred embodiment, the software program polls pin 34 (see FIG. 3B) to determine whether or not a voltage is present at connector CON4 (see FIG. 3D). The presence of a voltage indicates that neither the safety switch nor the front door switch have been tripped, and that further action by the control circuit should be permitted. In response to the concurrent presence of these input signals, microprocessor controller 120 issues appropriate instructions at pins 21-25 to the I/O controller 126. In response to the instructions from the microprocessor controller 120, the I/O controller 126 generates an appropriate signal at pin 3 and, through driver circuitry shown in the bottom right-hand corner of FIG. 3D, issues a drive signal to terminal B. This terminal is also shown in FIG. 3A, where a signal is applied to transistor T4. The signal is also transmitted through capacitor C8 and capacitor C10 to transistor C7. Transistors T4 and T7 cooperate to conduct current through motor connection terminals 3'-4', which are connected across the windings of clamping motor M1. In response to this energization, clamping motor M1 drives lead screws 14 in a direction to raise clamping plate 12. As mentioned, this upward movement of the clamping plate continues until the clamping plate reaches an end of travel condition or an operator releases the "up" switch S3'.

Alternatively, the upward travel of clamping plate 12 can be discontinued by an intervening signal from a limit switch positioned toward the upper end of clamping plate travel so as to detect the presence of the clamping plate at its uppermost position, and transmitting an electrical signal to microprocessor controller 120 which in turn will discontinue the drive signal to terminal B of motor control circuit 170. The action described thus far does not include many of the automatic control aspects of control system 100. This type of operation described above is important, for example, during an initial set up of the mixing apparatus 98, to allow a user to remove shipping materials which protect the clamping plate during transport of the mixing apparatus.

When an operator desires routine, automatic operation of mixing apparatus 98, the start switch S2' is momentarily pressed to indicate that diagnostics or initialization of the apparatus should be performed. The control system 100 checks for certain initial conditions before adjusting the position of pressure plate 12, to verify that the automatic control sensors and other portions of the control system are operating satisfactorily. First, the presence of a voltage at connector CON4 is monitored by polling pin 34 of microprocessor controller 120. If a voltage is present, a signal is transmitted to pin 34 through the invertor IC7C at the upper right corner of FIG. 3D. If either the safety switch 222 or the front door switch 224 are opened, voltage will not be present at CON4, and an error condition will exist. In response to the error condition, the microprocessor controller 120 can be programmed to generate instructions through I/O controller 126 to display interface 130, thus providing a visual indication on display 132.

Initialization continues as high speed reset circuit 149 is energized to produce a reset signal at pin 4 of microprocessor controller 120. After resetting the microprocessor controller 120, pin 34 is polled for the presence of voltage at connector CON4, and other pins are polled in sequence to determine proper circuit operation. For example, the voltage of voltage doubler circuit 160 is monitored at terminal L, coupled to pin 30 of microprocessor controller 120. If the voltage doubler circuit is malfunctioning an erroneous value will be detected at microprocessor controller pin 30 and the error code can be generated through I/O expander circuit 126 and display interface circuit 130 if desired.

Next, it is important to verify that the current draw in clamping motor M1 is accurately detected by the control system. As mentioned, the current draw is monitored by operational amplifier IC9 which tracks not only the instantaneous current draw of motor M1, but also the instantaneous rate of change of the current draw. These values are outputted at terminal J (see FIG. 3C) and are inputted to A/D converter circuit 124 at its pin 5. The current level and rate of change of motor draw current are recorded in microprocessor controller 120 to develop a histogram of motor current operation. During initialization, the signal at pin 5 of A/D converter 124 is monitored to ensure proper initial operation of operational amplifier IC9. This check will ensure that the operational amplifier IC9 is not driven by an erroneous input signal at its terminal 3.

As mentioned, the present invention contemplates two different operations of the control system depending upon whether an opto-coupler or shaft encoder is present or not. If the opto-coupler is included in the control system, its output, coupled to microprocessor controller pin 28 through connector CON3 invertor IC7B, is monitored to ensure a proper initial operation. After verifying the presence of a valid no-load or idle initial voltage at terminal J, a signal is applied to terminal B via instructions to I/O expander circuit 126, so as to switch on transistors T4-T7 of motor controller 170 (see FIG. 3A), thus initiating upward travel of clamping plate 12.

As opposed to the manual override raising of pressure plate 12, as explained above, operation during initialization of apparatus 98 is controlled or monitored for an automated operation. Hence, it is important to monitor the effect of energizing pressure plate motor M1. This monitoring can take a variety of forms. For example, microprocessor controller 120 can simply wait for the motor current to rise to a "stall" level or current level close thereto, indicating an end-of-travel condition. This will be realized by monitoring the signals from A/D converter 124 which responds to the signals from terminal J, applied to its input pin 5. If desired, a timer can be initiated within microprocessor controller 120 to determine if a current rise at terminal J takes an unacceptably long period of time.

As will be appreciated by those skilled in the art, some variance in the speed of pressure plate movement will arise from friction developed at lead screws 14. For example, the lead screws may become coated with foreign products during use. Such foreign products might include, for example, paint spills which become very viscous or hardened with time, and exposure to the environment. Accordingly, it is frequently desirable to further monitor the performance of pressure plate movement. Accordingly, if an opto-coupler is employed, rotations of the lead screw 14 are monitored at pin 28 of microprocessor controller 120.

In the preferred embodiment, it is desired to generate a train of two second windows while motor M1 is energized, and to count the number of revolutions of lead screw 14 in each window, to assess the motor drive operation. If no pulses are outputted from the opto-coupler, or if a very low number of pulses are detected, the microprocessor controller can instruct an error message to be displayed, by sending appropriate signal codes to I/O expander circuit 126. As will be appreciated by those skilled in the art, motor drive operation can be monitored for velocity, and rate of change of velocity and, if desired, can be correlated to motor current detected at terminal J, the output of motor sensor circuit 200.

In any event, the goal of this portion of the initialization procedure is to have the pressure plate 12 at a known standard position, usually the upper end-of-travel of the pressure plate. This will provide a reference position for further shaft encoding operations so that the revolutions of the leads screws can be used to calculate the absolute position of the clamping plate. If desired, microprocessor controller 120 can issue a display asking the operator to verify that the pressure plate 12 is indeed at its upper extent of travel and to indicate the reference positioning of the pressure plate by pressing an input switch such as the start switch S2'.

After completing initialization of the control system 100, the control system is continuously monitored to detect if various operating modes are initiated by a user. Four operating modes have been briefly described with reference to the flow diagram of FIGS. 4A–4C, although other, additional operating modes can also be implemented by the present invention.

According to an aspect of the present invention, the control system provides flexible operation. For example, the opto-coupler referred to above can be omitted, if desired, to reduce cost or for other reasons. If the opto-coupler is omitted, it is preferred that, after a mixing operation is completed, the pressure plate rise to the upper end of its travel to prepare for a subsequent mixing operation, and to allow removal of the container from the mixing apparatus. If, however, an opto-coupler is provided, it is preferred that the pressure plate be raised only a small, preselected minimum amount after completion of a mixing operation. The amount of minimum raising should be sufficient to allow removal of a container from the mixing apparatus, and to permit insertion of another container in the apparatus. With this option installed, the duration of a mixing operating cycle can be significantly reduced, and one type of multi-mode operation is made possible.

If an opto-coupler is not installed, it is generally preferred that the clamping plate motor be made to operate at a single speed. If, however, the opto-coupler is installed, it is possible and it is generally preferred that the pressure plate begin its descent toward a container at a higher rate of speed, and at a selected point of travel (hereinafter "switch-over" point), switch over to a lower speed in response to an alert signal generated at a particular rotation count. This represents another type of multi-mode operation. Other modes of operation are also possible. The present arrangement provides for the automatic sensing of a container by a pressure plate, but container size, i.e., distance above the support plate, can be input by a user, if desired.

Returning again to FIG. 4C, four different operating cycles have been described in the flow diagram. Briefly, the pre-defined "adjust" process 274 involves stepping through a series of eight settings or operating conditions for the mixing apparatus. The pre-defined "external handler" process 284 allows the direct input of operating parameters which at least partly determine control system operation, through potentiometers P1–P3. The pre-defined "two inches up motion" process 296 carries out the reduced or minimum raising of pressure plate 12 as referred to above. Also, the pre-defined "down motion" process 306 effects lowering of pressure plate 12 in one of two operating modes, either a single speed mode or dual speed mode with preselected "switch-over" or change-over point. The pre-defined "display shake time" process 316 sets the control system and preparation for a mixing operation and cycles through the "error" decision element 246, "door open" decision element 256, and "up pressed" decision element 290 to determine if the "start" button is pressed. If so, control is transferred to down motion process 306 which lowers the pressure plate 12 and controls the mixing operation.

The "external handler" process 284 is activated by pressing the "adjust" switch S1 a certain number of times, ranging between one and eight times. If the "adjust" button is pressed one time, the position of the "switch over" point is changed. Under dual speed operation, the pressure plate motor M1 switches at this point from a high speed at the beginning of its downward travel to a low speed. This distance is defined as a point on the lead screws from the top of travel of the pressure plate. The microprocessor controller 120 issues commands through I/O expander 126 to the display interface 130 to show the "switch-over" distance in centimeters. According to one aspect of the present invention, it has been found important in some applications to reduce the speed of the pressure plate travel in order to reduce the stored energy or "flywheel" effect of the pressure plate, thus providing a more delicate handling of containers to be mixed when such is desired.

The "adjust" process 274 also illuminates one of the three LED's, LD1–LD3, to indicate a particular potentiometer, one of the potentiometers P1–P3. The LED's are associated with individual ones of the potentiometers to provide a visual indication and to direct attention to a particular potentiometer. The "adjust" process 274 illuminates an LED immediately adjacent potentiometer Pl which provides an input of the "cross-over" distance desired.

If the value of potentiometer P1 is changed, the external data decision element 266 transfers control to external handler process 284, which transfers the instantaneous value of "cross-over" distance, based upon potentiometer setting to microprocessor controller 120. The microprocessor controller 120 then issues a signal via I/O expander 126 to display interface 130 to visually indicate the instantaneous setting of "cross-over" distance in centimeters, corresponding to the setting a user has selected with potentiometer P1. The instantaneous display of "cross-over" distance corresponding to the setting of potentiometer P1 is controlled by display process 282 of FIG. 4C, rather than the display process 272 associated with the "adjust" process 274.

If a user presses the "adjust" button S1 twice, the "adjust" process 274 issues commands through I/O expander 126 to display interface 130 so as to display a "low pressure" setting which has been stored in microprocessor controller 120. As will be seen herein, a related "high pressure" setting is also stored in the control system. The high and low pressures referred to here relate to clamping pressure imparted to a container by pressure plate 12 and are the subject of a further example of multi-mode operation. Smaller containers tend to be of a lighter gauge material and, in general, require more delicate handling, whereas larger sized containers are of a heavier construction. The larger containers are assumed to be taller than the smaller sized containers, and operation of the control system according to the principles of the present invention can be made to operate in a fully automatic mode without indicating the size of a particular container being mixed beforehand.

Preferably, the change-over in pressure settings occurs at the same point as change-over of the pressure plate speed, the change-over point being measured from the upper end of travel of the pressure plate and being related to a range of container sizes. The "adjust" process element 274 illuminates LED2 to direct a user's attention to potentiometer P2. Operation of potentiometer P2 constitutes an external handling operation controlled by process 284 with the instantaneous setting of potentiometer P2 being directly related to an instantaneous pressure setting displayed under control of process element 282 (see FIG. 4C).

If a user presses the "adjust" switch S1 three times, the stored value of the high pressure setting is displayed, potentiometer P3 is illuminated and high pressure values corresponding to the instantaneous setting of potentiometer P3 are displayed under control of I/O expander 126. The high and low pressure settings are compared to digital values relating to the output of operational amplifier IC9, at terminal J of motor sensor circuit 200. As the preset high and low pressure settings are approached, microprocessor controller 120 takes appropriate action to limit further pressure being developed on a container within apparatus 98.

When a user presses the "adjust" switch S1 four times, the "adjust" process element 274 causes the display interface 130 to display the limited or minimum or upward motion of pressure plate 12 between successive mixing operations. In the preferred embodiment of the control system, this assumes that an opto-coupler or the like rotation sensor is provided to monitor rotation of lead screws 14 and hence the instantaneous position of pressure plate. In the preferred embodiment, the minimum raising height is preferably set at about four centimeters or approximately two inches and is set by software, although those skilled in the art will readily appreciate that user defined settings can be accommodated in the manner described above with respect to potentiometers P1–P3 and that other modes of user defined settings can also be employed.

When the "adjust" switch S1 is pressed five times, the "adjust" process element 274 causes the display interface 130 to display the maximum current setting which is permitted for pressure plate clamping motor M1. In the preferred embodiment, the maximum current setting is defined at about four amperes, although other values can be selected depending upon motor characteristics, container structure and other considerations. The value of maximum current displayed is retrieved from a memory value which is stored in software associated with microprocessor controller 120. If desired, an external data handler for inputting maximum current values can be provided.

If the "adjust" switch is pressed six times, the process element 274 causes a "switch-over" current to be displayed at display interface 130. This setting assumes the presence of an opto-coupler or shaft encoder which provides dual speed and other types of multi-mode operations. The multi-modes of operation preferably relate to "switch-over points" on the lead screws, although they could be related to other operating parameters such as different shaking motions and durations automatically set according to container height, for example.

As mentioned above, the motor current of clamping motor M1 is continuously monitored by operational amplifier IC9, and an analog output signal at terminal J is converted into digital form and inputted into microprocessor controller 120. The current value, the slope of a current-time curve or histogram, area under the current time curve, and other observations relating to motor current performance are continuously monitored by microprocessor controller 120 to provide an accurate, sensitive control over the pressure applied to a container. As will be appreciated by those skilled in the art, a predictive control, one in which a changing clamping pressure can be predicted according to historical data, can also be employed. Stored in the software associated with microprocessor controller 120 is the current value of clamping motor M1, at which a change-over from high speed to low speed is made to occur by action of microprocessor controller 120, issuing an appropriate control signal through I/O expander circuit 126 to terminal E of voltage doubler circuit 160.

If the "adjust" switch S1 is pressed seven times, a value corresponding to the clamping pressure maintained during a mixing operation is displayed in display interface 130. According to one aspect of the present invention, after the clamping plate 12 contacts a container and is seated against the container, a mixing operation is initiated and, of course, clamping pressure on the container must be maintained during mixing.

According to one aspect of the present invention, the power applied to the clamping motor M1 during mixing by driving signals from the control circuit is carefully controlled by motor sensor circuit 200 and microprocessor controller 120 to closely control operation of clamping motor M1. In this operation, power to the clamping motor M1 is preferably not continuous, but is "chopped" according to a pre-defined duty cycle. Further, during the "on" portions of the clamping motor operating cycle, the power applied by motor M1 in response to the discontinuous driving signals is substantially less than the full power which can be realized by the clamping motor. According to one aspect of the present invention, a relatively low percentage of full motor power is encoded in the software or otherwise stored in microprocessor controller 120. This reduced power ranges between 5% and 25% and preferably between 11% and 15% of the clamping motor full power capability. This reduced percentage of full motor power is the value displayed in display interface 130. The discontinuous clamping can be initiated by sensing the position of the pressure plate or by setting a limit on the pressure developed by the pressure plate on the container. This second pressure limit may be the same as the first pressure limit at which "up" motion of the pressure plate is initiated after initial contact with a container. Also, the second pressure limit may be a fraction of the first pressure limit.

Pressing the "adjust" switch eight times returns the user to adjustment of the switch-over position, the same operation as pushing the "adjust" switch once.

Further user inputs are provided by DIP switch S2. Operation of DIP switch S2-1 relates to the presence or absence of an opto-coupler. If switch S2-1 is set to an "off" position, the control system operates without an opto-coupler, preferably at the high pressure setting controlled by potentiometer P3, as explained above. If the DIP switch S2-1 is set "on", an opto-coupler is indicated as being available to the control system, and the various multiple modes of operation, of pressure plate speed, pressure plate current, and both high and low clamping pressures, are enabled in the software associated with microprocessor controller 120.

If the DIP switch S2-2 is set to an "off" position, high speed operation of pressure plate 12 is disabled. This setting is advantageous in servicing the mixing apparatus and for taking certain pressure readings associated with apparatus set-up and maintenance. With DIP switch S2-2 set to an "on" position, high speed pressure plate operation is enabled, along with software routines in microprocessor controller 120 which back up the pressure plate away from a container, immediately after initial contact therewith, allowing the pressure plate to again start movement toward the container, traveling over a very small distance so as to slowly build up the clamping pressure on the container. This same back-off and recompress operation is preferably enabled for low speed pressure plate motion as well.

DIP switch S2-3 is turned on and off to allow upward movement of the pressure plate only when the front door switch is closed, or alternatively whether or not the front door switch is closed. The remaining DIP switch S2-4 is turned on and off to enable or alternatively override the front door switch.

Control system 100 provides a controlled, safe operation of the clamping and mixing motors, with special attention being given to reducing the chance that the machine will start mixing before a container is clamped sufficiently. As mentioned, a sophisticated and sensitive motor sensor circuit 200 with an integrated circuit operational amplifier IC9 is used to continuously monitor the clamping motor current. Accordingly, the present invention provides a sensitive and accurate measuring and adjustment of pressure applied to a container at any given instance of time. Accordingly, a user can selectively reduce pressure on smaller containers and can selectively increase clamping pressure on larger containers, according to user preferences, changes in container constructions and other operating conditions.

As can be seen from the above, the container dimensions are measured by an opto-coupler or shaft encoder which outputs a pulse for each incremental partial rotation of lead screws 14. Different clamping pressures can be set to switch over at a specific point in the travel of the pressure plate 12, and the current values associated with the respective pressures can be independently adjusted, using the potentiometers as described above. An immediate visual indication of pressure setting is provided by the present invention. As can be seen from the above, the distance of each pressure operating range can be displayed as well.

According to one aspect of the present invention, in order to ensure an accurate measuring of clamping pressure, it is important that the clamping motor M1 be allowed to build up clamping pressure gradually, so as to reduce stored energy in the clamping plate, thereby reducing the "flywheel effect". However, this competes with an interest in enhanced operating speed.

As can be seen from the above, the present invention provides increased operating speed with a dual speed mode of operation, and thus incorporates a high speed mode of operation which does not degrade accurate measurement of clamping pressure as explained above.

A typical operating cycle of apparatus 98 will now be described. Initially, it is assumed that the pressure plate 12 is in a random position, with power to apparatus 98 being turned off. When power is applied to the apparatus by operating switch 218, a pulse is sent to high speed reset circuit 149 which triggers a software reset function in microprocessor controller 120. Software in the microprocessor controller checks the various supply voltages associated with apparatus 98. Thus, it is possible to check whether a correct voltage is applied to apparatus 98, a question which is becoming increasingly important as European and Domestic equipment is transferred back and forth among various countries of the world. Various "error" checks are performed as indicated in the flow diagram of FIG. 4, and an appropriate error code is displayed if an error is encountered. If no error is detected, pressure plate 12 is moved to its highest end of travel with or without various checks, as explained above, and the opto-coupler or shaft encoder is reset to a reference value.

The clamping operation is thereafter called for by a user. Before a clamping operation or any movement of the clamping motor M1, whether upwardly or downwardly, circuitry of controller 100 is tested as explained above. If no errors are detected, the control circuitry responds to operation of start switch S2' by moving pressure plate 12 in a downward direction at the predetermined high speed. Assuming a relatively large sized container is placed in apparatus 98, the moment the pressure plate reaches the container, the current drawn by the clamp motor M1 begins to rise. When the clamping motor current passes a preset high pressure point or preset maximum current draw point, the polarity of the clamping motor voltage is reversed and the clamping plate is raised or "backed off" a small amount, typically a few millimeters. Thereafter, the clamping plate travels toward the container at the slow speed.

During downward movement at what is expected to be a very short distance, the opto-coupler pulses are counted, and if they are found to exceed an unreasonably large number, the mixing process is stopped and an appropriate error code is displayed. Assuming, however, that the motor current again rises with travel of the pressure plate over only a very small distance, thus indicating satisfactory performance, control of the clamping motor is transferred to a "chopping" operation at reduced power levels (as explained above), so as to maintain a clamping pressure on the container during a mixing operation.

Alternatively, assuming a relatively small size container is placed in the mixing apparatus, the pressure plate will travel through the "switch-over" point, which is predetermined in the manner described above, and high speed movement of the pressure plate will be switched over to a low speed, and preferably also a lower pressure mode of operation. When the pressure plate encounters a container, the current draw of the clamping motor will begin to rise. Preferably, the pressure plate is "backed off" a very small distance, and the clamping plate is again advanced toward the container. Alternatively, the "back-off" can be eliminated at low speed, low pressure conditions. In either event, operation of the clamping motor is switched over to a pulsed or "chopped" mode of operation which maintains clamping pressure on the container during a mixing operation as explained above. When clamping of the container is satisfactorily indicated, mixing will be initiated. Microprocessor controller 120 will send appropriate instructions to I/O expander circuit 126 which will issue a signal through the current drivers illustrated in FIG. 3D, to provide a signal at terminal F. The signal will switch transistor T10, thus energizing the shake motor. It is generally preferred that such energizing of the shake motor is delayed until a timer setting at terminal K is verified, thus indicating a desired mixing duration. As soon as the mixing starts, the clamp motor M1 will exert a reduced pressure on the container by reason of the pulsed, reduced power mode of operation described above. This has been found to effectively prevent "back off" of the pressure plate due to vibrations during the mixing process. According to one aspect of the present invention, the electrical power to clamping motor M1 is continuously or, alternatively, frequently monitored during a mixing operation to ensure the container is clamped during the mixing process. If an error is detected, microprocessor controller 120 immediately stops mixing operation and issues an error code to appear on the display. In the preferred embodiment, the mixing process can also be manually interrupted by pressing the "up" switch S3'.

When the mixing time has elapsed, power to the shake motor is discontinued and the mixer mechanism is allowed to come to a complete stand still. At this point, the microprocessor controller 120 can automatically issue a raising signal to the clamping motor, or the user can be required to push the "up" switch S3'. In either event, the pressure plate 12 is moved upwardly to allow removal of the container from the apparatus. If an opto-coupler is not present in the control system, the pressure plate is moved upwardly to its end of travel. As explained, if an opto-coupler is present, the pressure plate is raised only a very small amount so as to reduce a duration of the mixing apparatus operating cycle.

As those of skill in art will appreciate, electronic circuitry components associated with the pressure settings and with the clamping motor current measurement can drift with age. The presence of strong electromagnetic fields and wide variations in temperatures can accelerate this aging process, and hence the drifting of the operation of the electronic components. According to one aspect of the present invention, the control circuitry 100 continuously calibrates these circuit components each time movement of the pressure plate is called for. In addition, with every 100 mixing operations using an opto-coupler, the pressure plate 12 is returned to its upward end of travel condition to recalibrate the opto-coupler and its associated circuitry.

As can be seen from the above, the control system according to aspects of the present invention provides numerous advantages. Included among these advantages is the accurate and precise electronic measurement of clamping pressure current and provision for the control of that current, taking into account container size and other structural conditions. Two different pressure currents, one high and one low, can be independently set with the switch-over point also being determinable by a user. Further, the pressure plate is initially backed off of a container which is contacted during high speed operation. The pressure plate is lifted slightly and again moved toward the container, allowing the pressure to be built up slowly to provide an accurate detection of motor current magnitude and rate of change.

Further advantages are attained in the dual speed operation described above. For example, during high speed motor operation, current draw on the motor is reduced, thus reducing the amount of work developed on a container when contacted by the pressure plate. Further, at higher speed operation, the slope of the current-time curve generated at terminal J by motor sensor circuit 200 is steeper, and thus it is easier for the circuitry to detect a current value more quickly. Thus, in some respects, current detection is more sensitive at higher plate speeds.

As can be seen from the above, the present invention increases the throughput or capacity in an assembly line environment, while eliminating or substantially reducing the risk of damage to a container. Further, apparatus constructed according to principles of the present invention can automatically and readily adapt to containers of different sizes, and the shake duration times can be easily and carefully controlled. Further, if larger containers are to be mixed, mechanism of the preferred embodiment permits simultaneous mixing of multiple containers.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. Mixing apparatus for mixing contents in a container comprising:

container contacting means including a support plate and a pressure plate which is movable toward and away from the support plate;

actuator means operable in response to a plurality of driving signals to move the pressure plate toward and away from the support plate at a first, faster speed and at a second, slower speed;

circuit means coupled to said actuator means for producing said plurality of driving signals;

said circuit means responsive to input signals;

inputting means for inputting user-defined input signals, relative to parameters of the pressure plate travel, to said circuit means;

said circuit means responding to said user-defined input signals to result in said first and second speeds of movement of said pressure plate travel, said circuit means including programmable computer means and annunciator means coupled to said programmable computer means;

said inputting means includes switch means coupled to said programmable computer means; and said programmable computer means presents a sequence of messages to said annunciator means and processing respective operations of said switch means as a sequence of different user-defined input signals.

2. The apparatus of claim 1 wherein:

said apparatus further comprises pressure monitoring means for monitoring the pressure applied by said pressure plate to said container;

said user-defined input signals include at least one signal indicating a preselected pressure limit; and said apparatus further comprises pressure control means for comparing the monitored pressure to said preselected pressure limit and for altering the driving signals so as to alter the pressure applied to said container by said pressure plate and said support plate.

3. The apparatus according to claim 2 wherein said pressure monitoring means includes means for monitoring the power consumption of said actuator means.

4. Mixing apparatus for mixing contents in a container comprising:

container contacting means including a support plate and a pressure plate which is movable toward and away from the support plate;

actuator means including an electric motor, said actuator means operable in response to a plurality of driving signals to move the pressure plate toward and away from the support plate at a first, faster speed and at a second, slower speed;

circuit means coupled to said actuator means for producing said plurality of driving signals, said circuit means responsive to input signals;

inputting means for inputting user-defined input signals, relating to parameters of the pressure plate travel, to said circuit means;

pressure monitoring means for monitoring the pressure applied by said pressure plate to said container including power monitoring means for monitoring the power consumption of said actuator means;

said user-defined input signals including at least one signal indicating a preselected pressure limit;

pressure control means for comparing the monitored pressure to said preselected pressure limit and for altering the driving signals so as to alter the pressure applied to said container by said pressure plate and said support plate; and the power monitoring means comprises means for monitoring the electrical current inputted to said electric motor.

5. Mixing apparatus for mixing contents in a container comprising:

container contacting means including a support plate and a pressure plate which is movable toward and away from the support plate;

actuator means operable in response to a plurality of driving signals to move the pressure plate toward and away from the support plate at a first, faster speed and at a second, slower speed;

circuit means coupled to said actuator means for producing said plurality of driving signals, said circuit means responsive to input signals;

inputting means for inputting user-defined input signals, relating to parameters of the pressure plate travel, to said circuit means;

pressure monitoring means for monitoring the pressure applied by said pressure plate to said container including power monitoring means for monitoring the power consumption of said actuator means;

said user-defined input signals including at least one signal indicating a preselected pressure limit;

pressure control means for comparing the monitored pressure to said preselected pressure limit and for altering the driving signals so as to alter the pressure applied to said container by said pressure plate and said support plate; and means for generating a discontinuous driving signal when the power consumption of said actuator means exceeds the preselected limit.

6. Mixing apparatus for mixing contents in a container comprising:

container contacting means including a support plate and a pressure plate which is movable toward and away from the support plate;

actuator means operable in response to a plurality of driving signals to move the pressure plate toward and away from the support plate at a first, faster speed and at a second, slower speed;

circuit means coupled to said actuator means for producing said plurality of driving signals, said circuit means responsive to input signals;

inputting means for inputting user defined input signals, relating to parameters of the pressure plate travel, to said circuit means;

pressure monitoring means for monitoring the pressure applied by said pressure plate to said container;

said user-defined input signals include at least one signal indicating a preselected pressure limit; and said apparatus further comprises pressure control means for comparing the monitored pressure to said preselected pressure limit and for altering the driving signals so as to alter the pressure applied to said container by said pressure plate and said support plate, said pressure control means being coupled to said circuit means and sending signals to said circuit means, causing said circuit means to produce driving signals so as to reverse the direction of travel of said pressure plate, so as to displace the pressure plate a preselected distance in the reverse direction and resume the pressure plate travel toward the support plate.

7. The apparatus of claim 6 wherein said circuit means causes a change in the speed of travel of the pressure plate when pressure plate travel toward the support plate is resumed.

8. The apparatus of claim 6 further comprising reverse distance input means for inputting a user definable reverse distance signal proportional to the distance of pressure plate travel in the reverse direction.

9. The apparatus of claim 8 wherein said apparatus further comprises lead screw means threadingly engaged with said pressure plate so as to move said pressure plate, rotation monitoring means which monitors the rotation of said lead screw means, and wherein said user definable reverse distance signal is proportional to a preselected amount of rotation of said lead screw means.

10. The apparatus of claim 8 wherein said apparatus further comprises lead screw means threadingly engaged with said pressure plate so as to move said pressure plate, said actuator means includes a motor coupled to said lead screw means for rotation thereof in opposite directions, and said user definable reverse distance signal is proportional to a preselected time duration during which the motor is operated in a reverse direction.

11. Mixing apparatus for mixing contents in a container comprising:

container contacting means including a support plate and a pressure plate which is movable toward and away from the support plate;

actuator means operable in response to a plurality of driving signals to move the pressure plate toward and away from the support plate at a first, faster speed and at a second, slower speed;

circuit means coupled to said actuator means for producing said plurality of driving signals; and speed switching means responsive to pressure plate movement for altering the drive signals to said actuator means to cause a change in the speed of pressure plate travel, said speed switching means coupled to said circuit means and sending an alert signal to said circuit means when said pressure plate passes a preselected position.

12. The apparatus of claim 11 wherein said apparatus further comprises lead screw means threadingly engaged with said pressure plate so as to move said pressure plate, said actuator means includes a motor coupled to said lead screw means for rotation thereof in opposite directions, and said speed switching means includes rotation monitoring means for monitoring the rotation of said lead screw means.

13. The apparatus of claim 12 wherein said rotation monitoring means comprises an optical coupler adjacent said lead screw means and coupled to rotation counter means for monitoring the rotation of the lead screw means.

14. The apparatus of claim 12 wherein said rotation monitoring means is coupled to said circuit means and sends signals to said circuit means causing said circuit means to reverse the direction of travel of said pressure plate, to displace the pressure plate a preselected distance in the reverse direction and to resume the pressure plate travel toward the support plate.

15. Mixing apparatus for mixing contents in a container comprising:

a pair of spaced container contacting plates including a support plate and a pressure plate which is movable toward and away from the support plate;

actuator means operable in response to a plurality of driving signals to move the pressure plate in opposite directions toward and away from the support plate;

contact sensing means for sensing contact of the pressure plate with a container located between the pressure plate and the support plate, including contact sensing signal means for generating contact sensing signal for indicating such contact;

circuit means for producing said plurality of driving signals, coupled to said contact sensing means so as to receive said contact sensing signal, said circuit means responsive to said sensing signal to change the driving signals to said actuator means, so as to change the movement of said pressure plate in response to said driving signals; and said driving signals including signals for moving the pressure plate toward a container on the support plate, moving the pressure plate in a reverse direction in response to the contact sensing signal, and resuming movement of the pressure plate toward the support plate so as to apply pressure to said container.

16. The apparatus of claim 15 wherein said circuit means, in response to said contact sensing signal, sends signals to said actuator means causing said actuator means to reverse the direction of travel of said pressure plate, to displace the pressure plate a preselected distance in the reverse direction and to resume the pressure plate toward the support plate.

17. The apparatus of claim 16 wherein said actuator means responds to at least some of said driving signals to move said pressure plate at different rates of speed.

18. The apparatus of claim 17 wherein the pressure plate is initially moved toward the container at a first, faster speed and is moved toward the support plate at a second, slower speed when travel toward the support plate is resumed after a direction reversal.

19. Mixing apparatus for mixing contents in a container comprising:

a pair of spaced container contacting plates including a support plate and a pressure plate which is movable toward and away from the support plate;

actuator means operable in response to a plurality of driving signals to move the pressure plate in opposite directions toward and away from the support plate;

contact sensing means for sensing contact of the pressure plate with a container located between the pressure plate and the support plate, including contact sensing signals means for generating contact sensing signal for indicating such contact;

circuit means for producing said plurality of driving signals, coupled to said contact sensing means so as to receive said contact sensing signal, said circuit means responsive to said sensing signal to change the driving signals to said actuator means, so as to change the movement of said pressure plate in response to said driving signals;

position sensing means for sensing the position of said pressure plate relative to said support plate and for sending a position signal in response thereto, said circuit means including comparing means coupled to said position sensing means for comparing a position signal to a predefined position from said support plate corresponding to the size of a container to be mixed, and said comparing means coupled to said circuit means to cause driving signals to be received by said actuator means when said position signal indicates pressure plate position away from the predefined position and to cause driving signals to said actuator means to be discontinued when said position signal indicates pressure plate position close to said predefined position or between said predefined position and said support plate.

20. The apparatus of claim 19 wherein said actuator means includes lead screw means threadingly engaged with said pressure plate so as to move said pressure plate and a motor coupled to said lead screw means for rotation thereof in opposite directions, and said position sensing means monitors the rotation of said lead screw means.

21. The apparatus of claim 20 wherein said position sensing means comprises an optical coupler adjacent said lead screw means and coupled to a rotation counter means for monitoring the rotation of the lead screw means.

22. Mixing apparatus for mixing contents in a container comprising:

a pair of spaced container contacting plates including a support plate and a pressure plate which is movable toward and away from the support plate;

actuator means operable in response to a plurality of driving signals to move the pressure plate in opposite directions toward and away from the support plate;

contact sensing means for sensing contact of the pressure plate with a container located between the pressure plate and the support plate, including contact sensing signal means for generating contact sensing signal, for indicating such contact;

circuit means for producing said plurality of driving signals, coupled to said contact sensing means so as to receive said contact sensing signal, said circuit means responsive to said sensing signal to change the driving signals to said actuator means, so as to change the movement of said pressure plate in response to said driving signals; and said circuit means including pressure level setting means for defining the contact pressure at which contact is indicated by said contact sensing signal.

23. The apparatus of claim 22 wherein said pressure level setting means comprises pressure level input means for inputting a user defined pressure level setting.

24. The apparatus of claim 23 further comprising a second user defined input means for specifying a second pressure level setting at which said actuator means initiates discontinuous pressure plate travel toward the support plate.

25. Mixing apparatus for mixing contents in a container comprising:

a pair of spaced containers contacting plates including a support plate and a pressure plate which is movable toward and away from the support plate;

actuator means operable in response to a plurality of driving signals to move the pressure plate in opposite directions toward and away from the support plate;

contact sensing means for sensing contact of the pressure plate with a container located between the pressure plate and the support plate, including contact sensing signal means for generating contact sensing signal for indicating such contact;

circuit means for producing said plurality of driving signals, coupled to said contact sensing means so as to receive said contact sensing signal, said circuit means responsive to said sensing signal to change the driving signals to said actuator means, so as to change the movement of said pressure plate in response to said driving signals; and said contact sensing means including power monitoring means for monitoring the power consumption of said actuator means.

26. The apparatus according to claim 25 wherein the actuator means includes an electric motor and the power monitoring means comprises means for monitoring the electrical current inputted to said motor.

27. The apparatus according to claim 25 further comprising means for generating a discontinuous drive signal when the power consumption of said actuator means exceeds a preselected limit.

28. Mixing apparatus for mixing contents in a container comprising:

a pair of spaced container contacting plates including a support plate and a pressure plate which is movable toward and away from the support plate;

lead screw means threadingly engaged with said pressure plate;

actuator means operable in response to a plurality of driving signals to move the pressure plate in opposite directions toward and away from the support plate, said actuator means including a motor coupled to said lead screw means for rotation thereof in opposite directions;

rotation monitoring means for monitoring the rotation of said lead screw means and for generating a rotation signal indicative of the rotation; and circuit means for producing said plurality of driving signals, including means for receiving said rotation signal and for changing the driving signals to said actuator means in response thereto so as to change the movement of said pressure plate.

29. The apparatus of claim 28 wherein:

said apparatus further comprises means for inputting at least one user defined input signal in said circuit means, relating to a parameter of pressure plate travel; and said circuit means includes means for comparing said rotation signal to said input signal and for producing a driving signal in response thereto.

30. The apparatus of claim 29 wherein said circuit means responds to said at least one user-defined input signal and to said rotation signal so as to result in first and second speeds of movement of said pressure plate travel.

31. The apparatus of claim 30 further comprising user defined canceling means for canceling driving signals which result in said first and second speeds of movement of said pressure plate travel.

32. The apparatus of claim 28 further comprising window generating means for generating a consecutive series of time interval windows, said circuit means including means for producing a rotation counter estimate for each time interval window, for comparing the rotation counter estimate to said rotation signal and for generating an error signal if the comparison lies outside of a preselected value.

33. The apparatus according to claim 28 wherein said driving signals include a discontinuous drive signal produced in response to a preselected amount of rotation of said lead screw means.

34. Mixing apparatus for mixing contents in a container comprising:

a pair of spaced container contacting pressure plates movable toward one another so as to apply pressure to a container clamped therebetween and away from one another so as to release the container;

driving means operable in response to a plurality of driving signals to move the plates toward and away from one another;

circuit means for producing said plurality of driving signals in response to an input signal indicative of container size;

means for inputting an input signal in said circuit means, indicative of container size; and said driving signals including a first signal for initially moving said pressure plates at a first, faster speed and a second signal for moving said pressure plates at a second, slower speed as said pressure plates engage the container.

35. The apparatus according to claim 34 further comprising means for setting a preselected pressure limit imparted by said driving means to said container, and means for monitoring the pressure applied to said container and for comparing the monitored pressure to said preselected pressure limit.

36. The apparatus according to claim 35 wherein said pressure monitoring means comprises means for monitoring the power consumption of said driving means.

37. The apparatus according to claim 36 wherein the driving means includes an electric motor and the means for monitoring the power consumed by said driving means comprises means for monitoring the current inputted to said electric motor.

38. The apparatus according to claim 37 wherein the magnitude of current inputted to said electric motor is monitored.

39. The apparatus according to claim 37 wherein the rate of change of current inputted to said electric motor is monitored.

40. The apparatus according to claim 37 wherein said circuit means stops sending said driving signals to said electric motor when the power consumption of said electric motor exceeds the preselected limit.

* * * * *